US012716309B2

(12) United States Patent
Coplin et al.

(10) Patent No.: US 12,716,309 B2
(45) Date of Patent: Aug. 25, 2026

(54) DEVICES FOR MARKING A CORE SAMPLE

(71) Applicant: Imdex Technologies Pty Ltd, Balcatta (AU)

(72) Inventors: Nicholas Coplin, Balcatta (AU); Andrew March, Balcatta (AU); Neil Anthony Morrish, Balcatta (AU); James Barry Reilly, Balcatta (AU); Jacob Petersen, Balcatta (AU); Mark Gabbitus, Balcatta (AU); Nicholas Payne, Wembley Downs (AU); Pauline Newlove, Wembley Downs (AU); David Pritchard, Northcote (AU); Aaron Huy Nguyen, Keilor (AU); Brendyn Rodgers, Blackburn (AU)

(73) Assignee: IMDEX TECHNOLOGIES PTY LTD, Balcatta (AU)

( * ) Notice: Subject to any disclaimer, the term of this patent is extended or adjusted under 35 U.S.C. 154(b) by 0 days.

(21) Appl. No.: 18/855,120

(22) PCT Filed: Apr. 6, 2023

(86) PCT No.: PCT/AU2023/050280
§ 371 (c)(1),
(2) Date: Oct. 8, 2024

(87) PCT Pub. No.: WO2023/193059
PCT Pub. Date: Oct. 12, 2023

(65) Prior Publication Data

US 2025/0250874 A1 Aug. 7, 2025

(30) Foreign Application Priority Data

Apr. 8, 2022 (AU) ..... 2022900929
Jan. 23, 2023 (AU) ..... 2023900156

(51) Int. Cl.
*E21B 25/00* (2006.01)
*E21B 25/02* (2006.01)
*E21B 25/16* (2006.01)

(52) U.S. Cl.
CPC ..... *E21B 25/005* (2013.01); *E21B 25/02* (2013.01); *E21B 25/16* (2013.01)

(58) Field of Classification Search
CPC ..... E21B 25/16; E21B 25/02
See application file for complete search history.

(56) References Cited

U.S. PATENT DOCUMENTS

2018/0112483 A1 4/2018 Hejleh
2018/0363398 A1* 12/2018 Hejleh ..... E21B 25/16

FOREIGN PATENT DOCUMENTS

WO 2007/137356 A1 12/2007

OTHER PUBLICATIONS

Australian Patent Office, International Search Report issued in corresponding Application No. PCT/AU2023/050280 mailed May 22, 2023.

(Continued)

*Primary Examiner* — Giovanna Wright
(74) *Attorney, Agent, or Firm* — Stites & Harbison, PLLC; Terry L. Wright

(57) ABSTRACT

Device (10) for guiding a user to mark a core sample (12) carried by a core tube (14), the device (10) including: a housing (20) mountable relative to the core sample (12) or the core tube (14) and having a marking guide (22) configured to be arranged adjacent the core sample (12) to guide marking; a communications module (26) operable to communicate with the downhole tool (16) to receive data; a user interface (28) operable to convey perceptible feedback to the user; and a processor (30) and associated memory (32). The processor (30) is configured to store data in the memory (32)

(Continued)

and determine a marking position based on the data, and operate the user interface (28) to direct the user to cause relative rotation of the marking guide (22) and the core sample (12) so that the marking guide (22) is aligned with the marking position, allowing the user to use the marking guide (22) to mark the core sample (12) at the marking position.

23 Claims, 16 Drawing Sheets

(56) References Cited

OTHER PUBLICATIONS

Australian Patent Office, Written Opinion issued in corresponding Application No. PCT/AU2023/050280 mailed May 22, 2023.

* cited by examiner

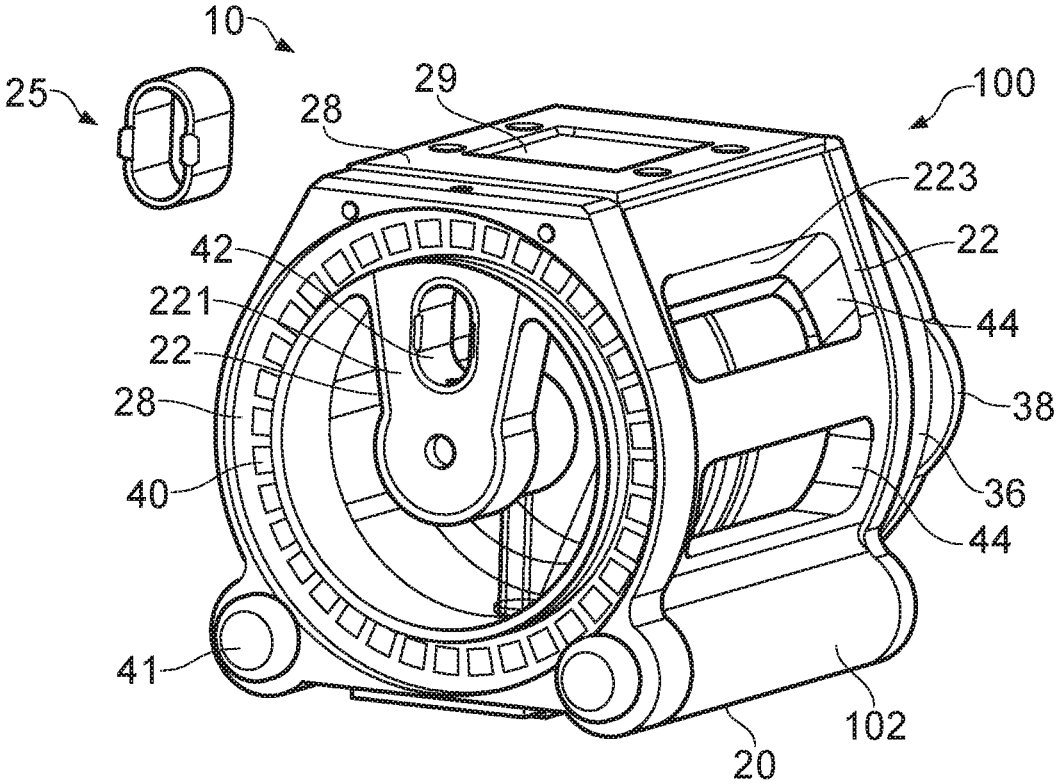
FIG. 3A
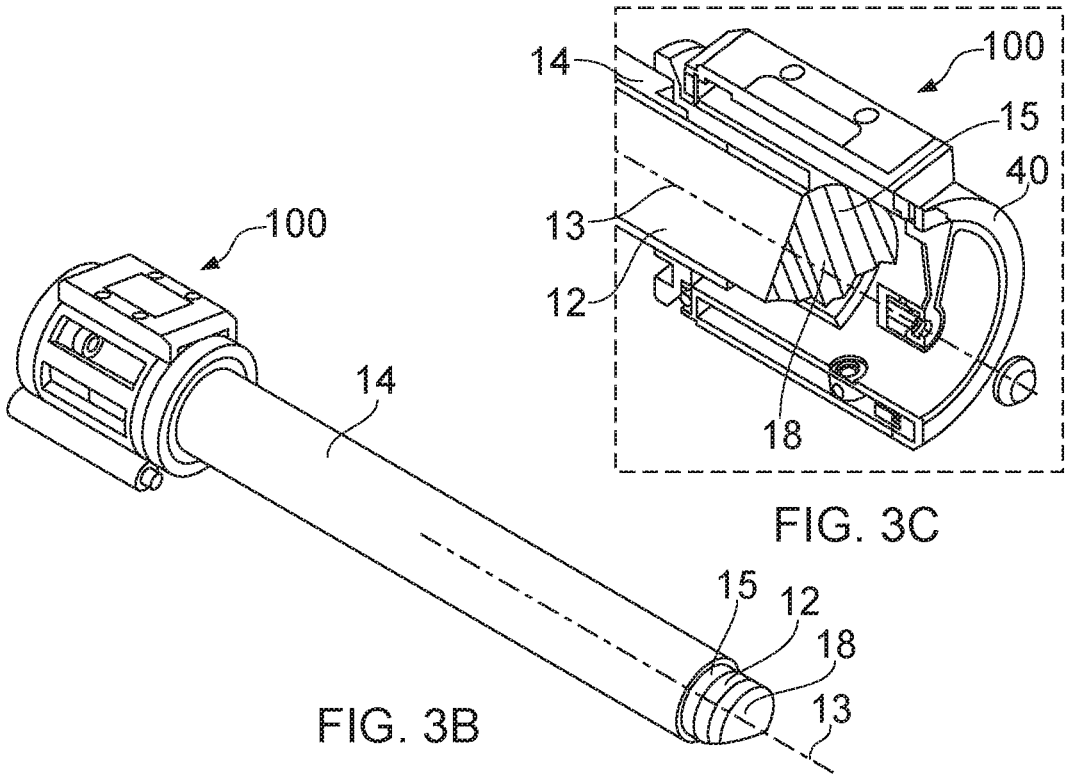
FIG. 3C
FIG. 3B

DEVICES FOR MARKING A CORE SAMPLE

TECHNICAL FIELD

The present disclosure relates generally to devices for guiding a user to manually mark a core sample extracted from bedrock to provide an indication of orientation of the core sample in situ. The disclosure also relates to devices for directly marking the core sample, and methods for marking a core sample to indicate orientation of the core sample in its original in situ position.

BACKGROUND

Core sampling is employed to allow geological surveying of underground mass formation. Analysis of the core sample provides information on the structure of the rock forming the sample. Core analysis data is useful in various fields, such as mineral exploration, and mine development.

To allow accurate analysis of the core sample, it is necessary for an analyst to be able to identify the orientation of the core sample relative to the bedrock from which it was extracted. Commonly, this requires identifying the Bottom of Core (BoC) position on the core sample, being the point on the core which was the lowest lying when in situ. In some situations, this may require identifying one or more other defined positions on the core, such as Top of Core (ToC). Identifying the one or more specific locations, such as BoC and ToC, allows the analyst to accurately determine the orientation of the core sample in situ and consequently map underground rock structure.

Obtaining core orientation information is typically achieved by securing an electronic orientation device, being a commonly used downhole tool or instrument, relative to a core tube (also referred to as an inner tube) and operating the device when positioned downhole to measure orientation. The orientation device is typically operated to record the orientation of the core sample immediately prior to being broken from the bedrock as this allows measuring a BoC or ToC position.

Once broken from the bedrock, the core sample, received in and carried by the core tube, is extracted to the surface. A user at the surface, often being a driller or drill operator, disconnects the core tube and orientation device from the head assembly, typically by unthreading a joint, and operates a handheld controller to form a communications link with the orientation device to obtain core orientation data stored in the device. The controller then displays instructions to direct the user to rotate the core sample, which inherently requires rotating the associated core tube, so that the lowest point of the underside of the core sample is arranged at the BoC position, or any other specific position which the orientation device has measured. This action can prove to be difficult, as the core sample and associated core tube is heavy, meaning that manually rotating both to accurately align with the specific rotational position is awkward, requires substantial time and energy, and/or can present an injury risk.

When the core sample is rotated to be aligned with the BoC position, the user places an orthogonal marking jig on the outer diameter of the core tube or core sample to extend across an end face of the sample, and manually marks the end face, such as with a pencil or crayon, to identify the BoC or ToC position. However, should the end face break from the bedrock to be non-perpendicular to the side, and/or define an uneven surface, this can arrange the marking jig to be inclined from the side, which can introduce parallax error to cause an inaccurate mark to be added to the end face. Furthermore, the marking jig can be misplaced, or intentionally omitted, by a user, which can result in the user manually estimating where the BoC or ToC position is and marking that position, which can be highly inaccurate.

Any discussion of documents, acts, materials, devices, articles or the like which has been included in the present specification is not to be taken as an admission that any or all of these matters were common general knowledge in the field relevant to the present disclosure as it existed before the priority date of each of the appended claims.

SUMMARY

According to some disclosed aspects, there is provided a device for guiding a user to mark a core sample carried by a core tube, the core tube associated with a downhole tool configured to record data relating to the orientation of the core sample in situ, prior to, or immediately after, being broken from bedrock, the core sample defining a longitudinal axis between opposed ends. The device includes: a housing mountable relative to the core sample or the core tube, the housing having a marking guide configured to be arranged, in use, adjacent at least one of an end and side of the core sample to guide marking the core sample; a communications module carried by the housing and operable to communicate with the downhole tool to receive data; a user interface carried by the housing and operable to convey perceptible feedback to the user; and a processor and associated memory carried by the housing, the processor communicatively coupled to the communications module and the user interface, and configured to store the data in the memory. The processor is further configured to determine a marking position based on the data, and operate the user interface to direct the user to cause relative rotation of the marking guide and the core sample so that the marking guide is aligned with the marking position, thereby allowing the user to use the marking guide to mark the core sample at the marking position.

The user interface may include at least one light emitter, and the processor be configured to selectively illuminate the at least one light emitter to indicate a direction of the relative rotation.

The user interface may include a plurality of the light emitters configured to be arranged, in use, at least partially about the longitudinal axis, and the processor be configured to selectively illuminate one or more of the light emitters to indicate the direction of the relative rotation.

The processor may be configured to operate a first light emitter to emit a first light to indicate the marking position, and operate one or more second light emitters to emit a second light to indicate the location of the marking guide. The first light may comprise a first colour, and the second light comprise a second colour.

The processor may be configured to operate the one or more second light emitters to indicate a direction of rotation of the marking guide towards the marking position. The processor may be configured to operate one or more of the light emitters to pulse light when the marking guide is aligned with the marking position.

The light emitters may be arranged in an annular array configured, in use, to at least partially surround the longitudinal axis. The annular array may be configured to be arranged, in use, adjacent an end of the core sample. The marking guide is configured to extend radially inwardly relative to the annular array to allow marking the end of the core sample.

The housing may define, or carry, one or more contact portions arranged to be placed against a side of the core sample or the core tube to allow mounting the housing relative to the core sample or core tube. The one or more contact portions may be defined by a receiving portion dimensioned to receive part of the core tube. The receiving portion may include a sleeve mountable to, or integrally formed with, the housing. The sleeve may define one or more guiding surfaces, where the, or each, guiding surface is arranged to allow marking the side of the core sample. The, or each, guiding surface may be arranged in a specific orientation relative to a centre line of the marking guide to allow marking the side of the core sample at a specific angle relative to the centre line. The sleeve may define a pair of the guiding surfaces spaced equally from opposed sides of the centre line such that each guiding surface is arranged at 45 degrees, or 90 degrees, to the centre line.

The device may further include an insert securable within the receiving portion, the insert defining an internal diameter dimensioned to fit to the core tube. The insert may be slidably engageable with the receiving portion to allow moving axially relative to the housing along the longitudinal axis.

The device may include at least a pair of contact portions, where each contact portion includes an elongate magnetic member arranged to allow releasably mounting the housing on a sidewall of the core tube. The device may include at least three contact portions arranged to define an annular array, and each contact portion be radially displaceable relative to a centre of the array. Each contact portion may be defined by an elongate member, such as leg or arm, extending from the housing.

The device may also include one or more planar light emitters arranged to emit a plane of light, the, or each, planar light emitter aligned with the marking guide to allow illuminating the core sample to display a line along the core sample.

The marking guide may define one or more surfaces configured to be arranged along at least one of the side and end of the core sample to allow guiding the user to mark the core sample. The marking guide may define an aperture dimensioned to receive an implement operable to apply a mark.

The marking guide may be associated with a detector arranged to detect presence of a marking implement adjacent the one or more surfaces, the detector communicatively coupled with the processor such that responsive to the detector detecting the marking implement, the processor is configured to record a marking event in the memory. The detector may include a switch arranged to be operated by the marker.

The device may also include a marking insert defining an aperture for receiving a specific marker, and the marking guide be dimensioned to receive the marking insert.

The marking guide may include an annular array of light emitters configured to be arranged, in use, about an end of the core sample, and the processor configured to illuminate a pair of opposed light emitters located either side of the marking position such that the marking position is coincident with a straight line between the opposed emitters, where illuminating the opposed emitters guides the user to mark a line along the sample between the opposed emitters.

The marking guide may include an annular array of light emitters configured to be arranged, in use, about an end of the core sample, and the processor configured to illuminate at least one of the emitters to project a line at least partway across the end of the core sample such that the marking position is coincident with the line to guide the user to mark the line along the sample.

The user interface may be operable to convey one or more of visible, audible, and haptic feedback to the user to direct the user to cause the relative rotation.

The user interface may include a display operable to display graphics to direct the user to cause the relative rotation.

The marking guide may be movably engaged with the housing to allow moving between a storage position and a use position.

The marking guide may be releasably engaged with the housing to allow detaching from the housing.

The device may include a marking alignment button operable to cause the processor to store a current orientation of the device in the memory. In such embodiments, responsive to storing the current orientation, the processor may be operable to communicate with the downhole tool, via the communications module, to confirm if the stored current orientation corresponds with the core orientation data stored in the downhole tool.

The downhole tool may be connected to the core tube and an uphole component, and the communications module may be configured to allow communication with the downhole tool when connected to the core tube and the uphole component.

The uphole component may define at least one communication path, and the communications module be carried by the housing to allow communication with the downhole tool via the at least one communication path.

The uphole component may define at least one conduit from an external surface of the uphole component to an internal region, and the downhole tool be arranged in or adjacent the internal region, and the housing may be shaped to allow mounting to the core tube or uphole component to align the communications module with the conduit to allow communication with the downhole tool.

The device may include a second communications module configured to communicate with the downhole tool and communicatively coupled to the processor, the second communications module arranged by the housing to allow communicating with the downhole tool when connected to the core tube and disconnected from the uphole component, and the processor be configured to execute first instructions responsive to receiving the data from the communications module, and configured to execute second instructions responsive to receiving data from the second communications module.

The device may include an imaging module communicatively coupled with the processor and operable to generate an image of the core sample. The imaging module may be fixedly mounted to the housing to allow positioning the imaging module adjacent the core sample.

According to other aspects of the disclosure, there is provided a device for marking a core sample carried by a core tube, the core tube associated with a downhole tool configured to record data relating to the orientation of the core sample in situ, prior to or immediately after being broken from bedrock, the core sample defining a longitudinal axis between opposed ends. The device includes: a housing mountable relative to the core sample or the core tube; a marking system carried by the housing and operable to mark at least one of an end and a side of the core sample at one or more positions defined relative to the longitudinal axis; a communications module carried by the housing operable to communicate with the downhole tool to receive data; and a processor and associated memory carried by the housing, the processor communicatively coupled to the marking system and communications module, and configured to store the data in the memory. The processor being further configured to determine a marking position based on data, and operate the marking system to mark the core sample at the marking position.

The marking system may include one or more light emitters arranged to emit light to cause marking the core sample.

At least one of the housing and the marking system may be configured to be rotatable about the longitudinal axis, and the device may further include a translation mechanism operable to rotate one of the marking system and the housing about the core sample or the core tube such that the marking system is arranged in a defined position relative to the marking position to allow operating the marking system to mark the core sample.

According to other aspects of the disclosure, there is provided a device for marking a core sample carried by a core tube, the core tube associated with a downhole tool configured to record data relating to the orientation of the core sample in situ, prior to or immediately after being broken from bedrock, the core sample defining a longitudinal axis between opposed ends, the device including: a housing mountable relative to the core sample or the core tube; an imaging system carried by the housing and operable to generate a digital representation of a portion of the core sample; a communications module carried by the housing and operable to communicate with the downhole tool to receive data; and a processor and associated memory carried by the housing, the processor communicatively coupled to the imaging system and communications module, and configured to store the data in the memory. The processor being further configured to determine a marking position based on the data, and manipulate the digital representation of the portion of the core sample to identify the marking position.

The device as described in any of the above paragraphs may be configured such that the marking position is determined to indicate one of Bottom of Core position and Top of Core position.

The processor may be configured to communicate with the downhole tool, via the communications module, to obtain orientation data defining the orientation of the core sample in situ and, responsive to receiving the orientation data, determine the marking position relative to the longitudinal axis of the core sample, based on the orientation data.

According to a further aspect of the disclosure, there is provided a method of marking a core sample to indicate orientation of the core sample in situ, prior to or immediately after being broken from bedrock, the core sample carried by a core tube and defining a longitudinal axis between opposed ends, the method including: operating a downhole tool associated with the core tube to record data relating to the orientation of the core sample in situ, prior to or immediately after being broken from bedrock; operating a marking guide device to communicate with the downhole tool to receive data, wherein responsive to receiving the data, a processor of the marking guide device determines a marking position relative to the longitudinal axis; positioning the marking guide device relative to the core sample or the core tube; causing relative rotation of at least a portion of the marking guide device and the core sample to prompt a user interface of the marking guide device to convey feedback to direct the relative rotation so that the at least a portion of the device aligns with the marking position; and operating a marking implement at or adjacent a marking surface of the marking guide device to mark the core sample at the marking position.

According to a further aspect of the disclosure, there is provided a method of marking a core sample to indicate orientation of the core sample in situ, prior to or immediately after being broken from bedrock, the core sample carried by a core tube and defining a longitudinal axis between opposed ends, the method including: operating a downhole tool associated with the core tube to record core orientation data relating to the orientation of the core sample in situ, prior to or immediately after being broken from bedrock; positioning a marking guide device relative to the core sample or the core tube and using the marking guide device to apply a first mark to the core sample at a first position; operating the device to record the first position; operating the marking guide device to communicate with the downhole tool to receive the core orientation data, such that responsive to receiving the core orientation data, a processor of the marking guide device determines a marking position relative to the first position; positioning the marking guide device relative to the core sample and operating the device to guide relative rotation of the device and the core sample so that a portion of the device is aligned with the marking position; and using the marking guide device to apply a second mark to the core sample at the marking position.

According to a further aspect of the disclosure, there is provided a method of identifying orientation of a core sample in situ, prior to or immediately after being broken from bedrock, the method including: operating a downhole tool associated with a core tube arranged to receive the core sample to record orientation data relating to the orientation of the core sample in situ, prior to or immediately after being broken from the bedrock; obtaining, via a communications module, the orientation data from the downhole tool; determining, by a processor, a marking position based on the orientation data; positioning an imaging system relative to the core sample and operating the imaging system to generate a digital representation of a portion of the core sample; and manipulating, by the processor, the digital representation to identify the marking position.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

It will be appreciated embodiments may comprise steps, features and/or integers disclosed herein or indicated in the specification of this application individually or collectively, and any and all combinations of two or more of said steps or features.

BRIEF DESCRIPTION OF DRAWINGS

Embodiments will now be described by way of example only with reference to the accompany drawings in which:

FIG. 3A is an alternative exploded view of the device shown in the previous figures;

FIG. 3B is a perspective view of the device of the previous figures arranged on a core tube to receive the back-end of a core sample;

FIG. 3C is a cross-sectional perspective view of the device of the previous figures arranged on a core tube to receive the front-end of a core sample;

DESCRIPTION OF EMBODIMENTS

Figure 1A:
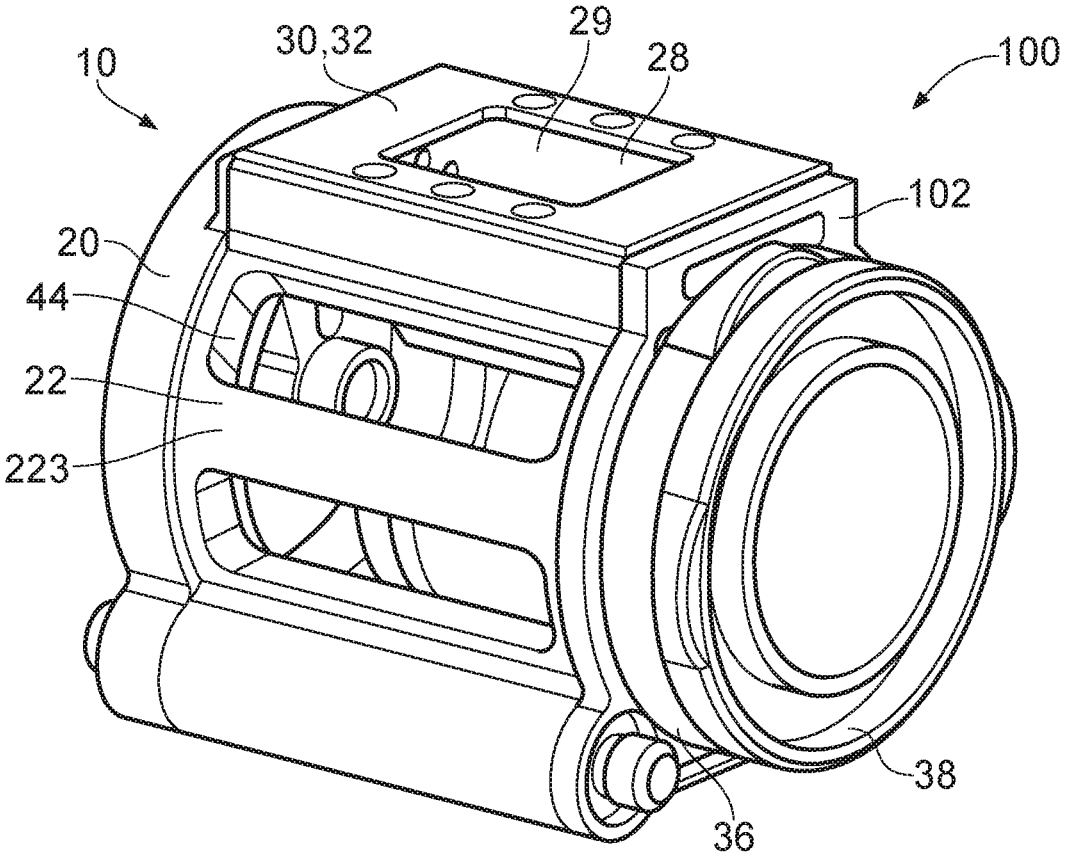
FIGS. 1A and 1B are perspective and exploded views, respectively, of a first embodiment of a device for guiding a user to mark a core sample.

In the drawings, reference numeral 10 generally designates a device 10 for guiding a user to mark a core sample 12 carried by a core tube 14, where the core tube 14 is associated with a downhole tool 16 configured to record data relating to the orientation of the core sample 12 in situ, prior to or immediately after being broken from bedrock, and the core sample 12 defines a longitudinal axis 13 between opposed ends 18.

The device 10 includes: a housing 20 mountable relative to the core sample 12 or the core tube 14, the housing 20 having a marking guide 22 configured to be arranged, in use, adjacent at least one of an end 18 and side 15 of the core sample 12 to guide marking the core sample 12; a communications module 26 carried by the housing 20 and operable to communicate with the downhole tool 16 to receive data; a user interface 28 carried by the housing 20 and operable to convey perceptible feedback to the user; and a processor 30 and associated memory 32 carried by the housing 20, the processor 30 communicatively coupled to the communications module 26 and the user interface 28, and configured to store the data in the memory 32. The processor 30 is configured to determine a marking position based on the data, and operate the user interface 28 to direct the user to cause relative rotation of the marking guide 22 and the core sample 12 so that the marking guide 22 is aligned with the marking position, thereby allowing the user to use the marking guide 22 to mark the core sample 12 at the marking position.

The processor 30 of the device 10 is typically configured to communicate with the downhole tool 16, via the communications module 26, to obtain orientation data defining the orientation of the core sample 12 in situ. Responsive to receiving the orientation data, the processor 30 is configured to determine the marking position relative to the longitudinal axis 13 of the core sample 12, based on the orientation data. Alternatively, in some embodiments, a processor of the downhole tool 16 is configured to determine the marking position based on the orientation data measured by the tool 16, and convey marking position data to the device 10. In such embodiments, the processor 30 of the device 10 is configured to determine the marking position based on the marking position data, and operate the user interface 28 to guide marking of the core sample 12.

Generally, the device 10 is operable to determine the marking position based on the core orientation data measured by the downhole tool 16 and, as a result, guide manual marking of the core sample 12, or effect marking of the core sample 12, or a digital representation of the core sample 12, to identify the marking position. It will be appreciated that to achieve this, the processor 30 is typically communicatively connected to one or more accelerometers and/or other sensors, such as carried by the housing 20, which are operable to determine orientation of the device 10, such as relative to a gravity vector. It will also be appreciated that the processor 30 is configurable to determine the marking position to be any specific location relative to the longitudinal axis 13 of the core sample 12, or, in some applications, relative to another point or frame of reference defined by or relating to the core sample 12. Typically, the marking position is defined to correspond with the Bottom of Core (BoC) position which is recorded by the downhole tool 16 in the form of a core orientation device. In some applications, the marking position is defined to correspond with the Top of Core (ToC) position recorded by the downhole tool 16.

Figure 7:
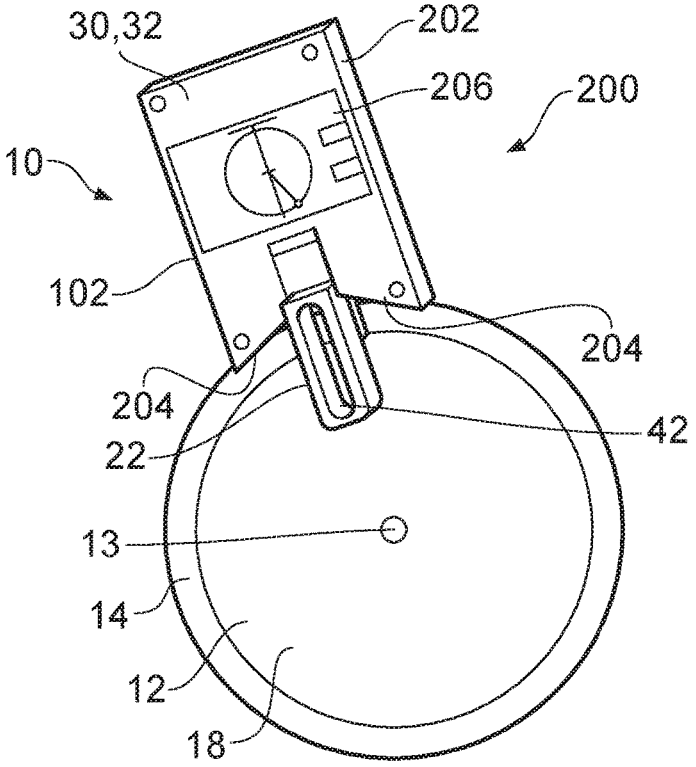
FIG. 7 is a perspective view of a second embodiment of a device for guiding a user to mark a core sample.
Figure 9:
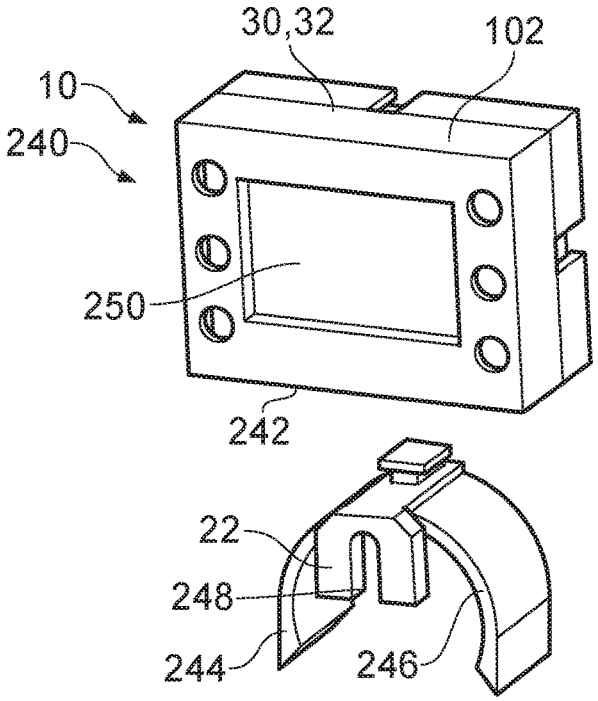
FIG. 9 is a perspective view of a fourth embodiment of a device for guiding a user to mark a core sample.

FIGS. 1 to 5A, and 5C, show a first embodiment 100 of the device 10 including a housing 102 shaped to receive an end 18 of the core sample 12 and a portion of the core tube 14. The housing 102 defines a receiving portion, the form of a sleeve section, into which the core sample 12 and tube 14 may be inserted. In the illustrated embodiment, the sleeve section defines an annular aperture 34 shaped to encircle the core sample 12 or core tube 14, where the side wall of the aperture 34 defines a contact portion for placing against a side of the core sample 12 or tube 14. The aperture 34 defines a central axis 35 which is arranged, in use, to be coaxial with the longitudinal axis 13 of the received core sample 12. Arranging the housing 102 to surround the core sample 12 or core tube 14 allows relative rotation of the housing 102 and core sample 12 about the axis 13 of the core sample 12, as described in greater detail below. It will be appreciated that, in other embodiments, such as illustrated in FIGS. 7 and 9, the housing 102 is shaped to only partially surround the core sample 12.

The aperture 34 may be dimensioned to fit closely to a specific core sample 12 or core tube 14 diameter, or fit to an adaptor which defines an aperture dimensioned to receive and abut a specific core sample 12 or core tube 14. Whilst the aperture 34 is shown as being defined by a cylindrically-shaped opening, it will be appreciated that, in other embodiments (not illustrated), the aperture 34 may be defined by the inwardly facing ends of an annular array of radially extending ribs or fins to minimise contact with, and/or centralise, the core sample 12, core tube 14, and/or adaptor. In some embodiments, only three radially extending projections, or bearings, are provided to position the device 100 on the core tube 14 or sample 12. In such embodiments, the radially extending projections or bearings may be resiliently mounted relative to the housing 102 to allow deflection away from the axis 13 of the core 12. This can usefully adjust the effective diameter of the aperture 34, such as to allow fitting the housing 102 to a range of different core sample 12 sizes or shapes, or different core tubes.

Figure 1B:
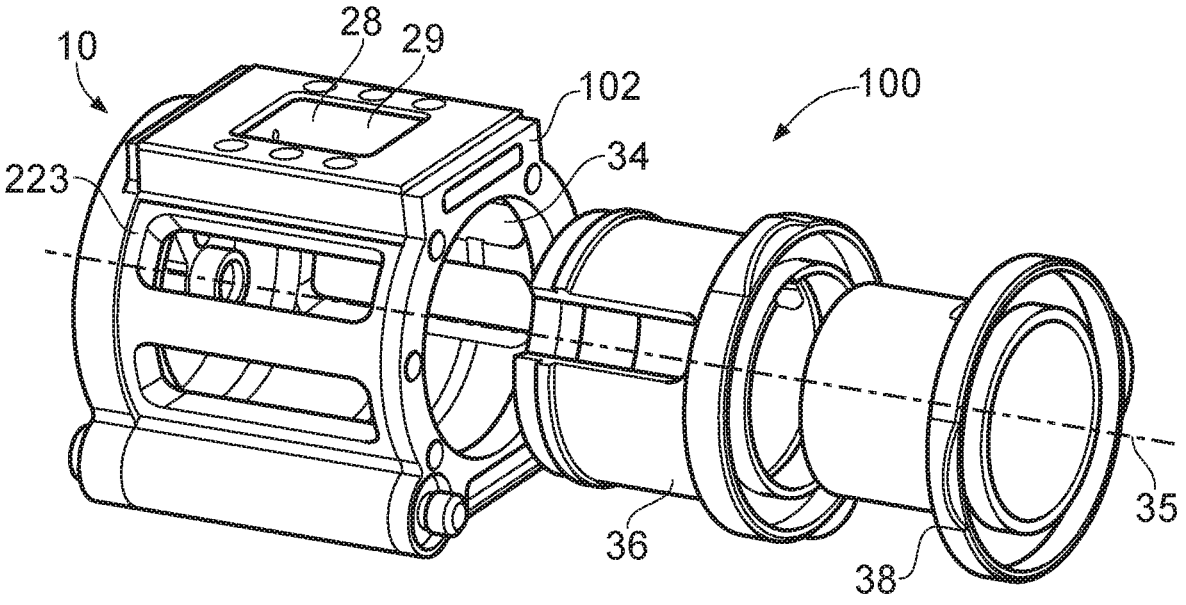

Best shown in FIG. 1B, the device 100 may include two adaptors 36, 38 configured to be releasably secured to each other and mountable to the housing 102. It will be appreciated that this configuration of the adaptors 36, 38 is exemplary and that the device 100 may be mounted to the core sample 12 or tube 14 directly, or via only a single adaptor 36. Mounting the device 100 to the sample 12 or tube 14 via the adaptors 36, 38 allows one or both adaptors 36, 38 to be readily substituted with another adaptor defining a different internal diameter to allow receiving an alternatively dimensioned core sample 12 or tube 14. For example, the device 100 may be supplied with a kit of adaptors, defining a range of different internal diameters, to allow receiving core tubes of various sizes, including but not limited to, standard core tube sizes "A", "B", "N", "H", and "P".

Whilst each adaptor 36, 38 is shown configured as a sleeve having a flange at one end, it will be appreciated that the adaptors 36, 38 are configurable in other forms to allow adjusting the effective internal diameter of the housing 102, such as comprising radially extending ribs or splines, and/or including radially displaceable structures, such as spring-loaded buffers, or cams. Furthermore, the adaptors 36, 38 may be configurable to be at least partially resiliently deformable to allow conforming to a received core tube 14 or core sample 12. Generally, the sleeve form of the adaptors 36, 38, and/or the housing 102, is useful as this allows the device 100 to be securely mounted along a portion of the core tube 14 without requiring support from any other structure or the user, consequently allowing the user to use both hands for other tasks.

At least one of the adaptors 36, 38 is typically configured to slidably engage with the housing 102 or the other adaptor 36, 38 to allow telescopically adjusting the position of the housing 102 relative to a received core sample 12. This may allow axially spacing the housing 102 from the end of the received core tube 14, for example, to enhance access to, and mark, a tapered or sloped end of a core sample 12.

Figure 2A:
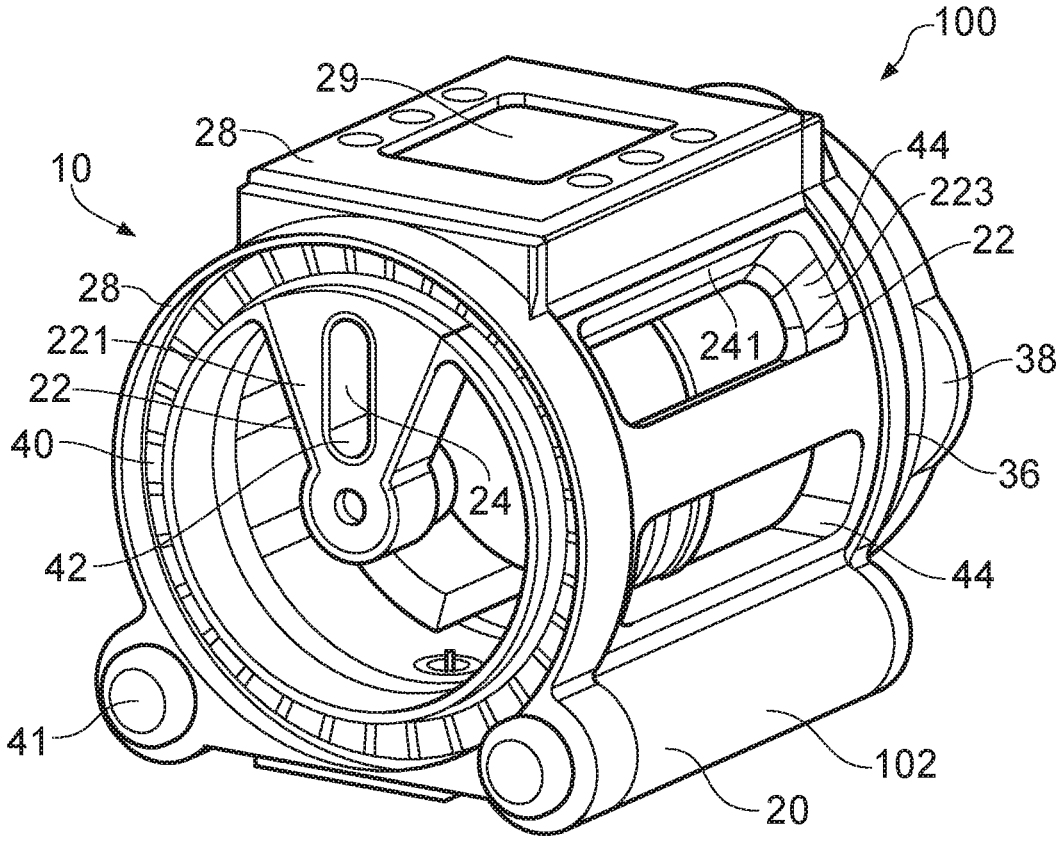
FIGS. 2A and 2B are a perspective and view, respectively, of the device shown in the previous figures.
Figure 2B:
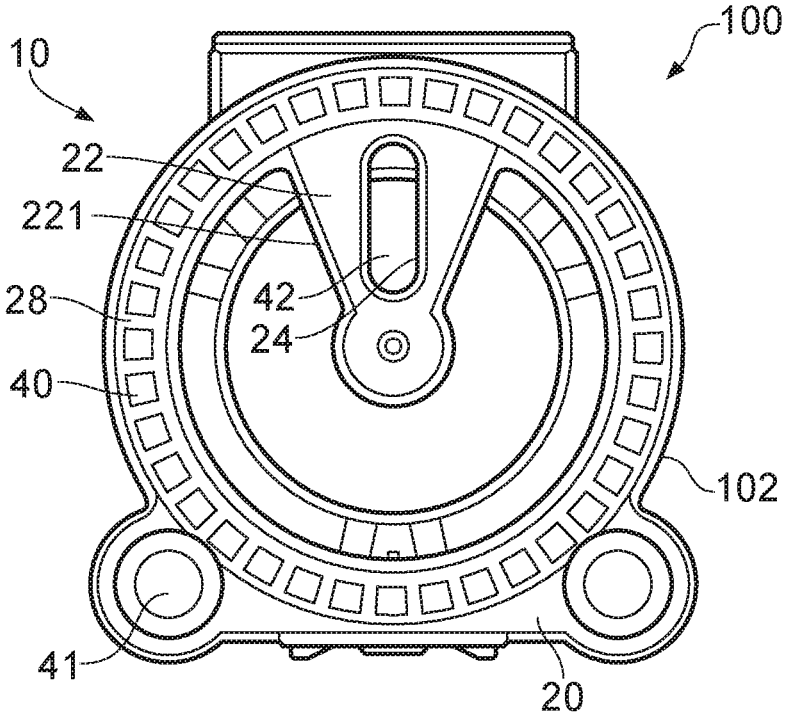

FIGS. 2A and 2B show an aspect of the user interface 28 of the first embodiment 100, being an array of light emitters 40 configured to be arranged, in use, at least partially about the longitudinal axis 13 of the core sample 12. In this embodiment 100, the light emitters 40 are in the form of LEDs arranged in an annular array about an end of the housing 102. In other embodiments (not illustrated), the emitters 40 are arranged in an array wrapping at least partially around a side of the housing 102. Best shown in FIG. 3C, the configuration of the array, in use, positions the light emitters 40 to surround the axis 13 of the received core sample 12. The light emitters 40 are operable independently of each other to allow directing the user to cause relative rotation of the housing 102 and the core sample 12, in a required direction about the axis 13 of the core sample 12, to align the marking guide 22 with the marking position. The emitters 40 may be configured to emit one or more specific types of light, such as by emitting one or more colours and/or intensity of light, and illuminate for a specific duration, such as to flash or pulse light. Operating a plurality of the light emitters 40 may be coordinated, by the processor 30, to emit one or more specific light sequences or patterns.

The housing 102 of the illustrated embodiment 100 is configured for fitting to the core sample 12 or tube 14 and the device 100 operable to guide rotating the housing 102 about the axis 13 of the core sample 12. It will be appreciated that the housing 102 is alternatively mountable at a fixed position to allow partially receiving the core sample 12, to alternatively mount the housing 102 relative to the core sample 12. In such arrangements, the device 100 is operable to guide the user to rotate the core sample 12 to cause the relative rotation.

Whilst this embodiment 100 is shown with an array of thirty six light emitters 40, such that each light 40 represents ten degrees of rotation, it will be appreciated that the array may include more, or less, emitters 40. For example, in some embodiments (not illustrated), the array includes three hundred and sixty emitters 40 so that each emitter 40 represents one degree of rotation. In other embodiments (not illustrated), the array includes only three emitters 40 to only partially surround the axis 13 of the core sample 12, being operable to allow indicating rotate left, rotate right, and stop. In yet other embodiments, the user interface 28 may include only a single light emitter 40 configured to be operable in different ways to indicate the required relative rotation direction, such as emitting one colour of light, and/or flashing light at one frequency, to indicate rotate left, and emitting another colour of light, and/or flashing light at a second frequency, to indicate rotate right.

Best shown in FIG. 2B, a first aspect 221 of the marking guide 22 of the illustrated embodiment 100 is integrally formed with the housing 20 such that the marking guide 22 is arranged to extend radially inwardly relative to the array of light emitters 40, in this embodiment extending partially across the annular array. The first aspect 221 of the marking guide 22 defines surfaces 24 for guiding manual marking of the end 18 of the core sample 12. As shown in FIG. 3C, when the housing 102 is mounted to the core sample 12, or more typically mounted to the core tube 14, this arrangement of the marking guide 22 arranges the guide 22 across the end 18 of the core sample 12 to allow a user to mark the end 18. It will be appreciated that the housing 102 is mountable to the front (downhole) end of the core tube 14, as shown in FIG. 3C, to allow marking the end 18 of the core sample 12, or the rear/back (uphole) end of the core tube 14, as shown in FIG. 3B, to allow identifying the marking position, and, in some embodiments, to allow marking the side of the core tube 14 adjacent the uphole end with side marking apertures 44, as described in greater detail below.

In this embodiment 100, the first aspect 221 of the marking guide 22 is fixed relative to the housing 102. In other embodiments, the marking guide 221 is movably mounted to the housing 102, such as to allow pivoting between a storage and use position, and/or rotating relative to the housing 102, such as, in use, rotating about the axis 13 of the received core sample 12. This may allow manually rotating the marking guide 221 to align with the marking position while the housing 102 remains static relative to the core sample 12 and core tube 14. In yet other embodiments (not illustrated), the marking guide 221 is associated with a drive mechanism operable to move the marking guide 221 about the axis 13. In such embodiments, rotation of the marking guide may be controlled by the processor 30 responsive to determining the marking position based on the data obtained from the downhole tool 16.

Figure 17:
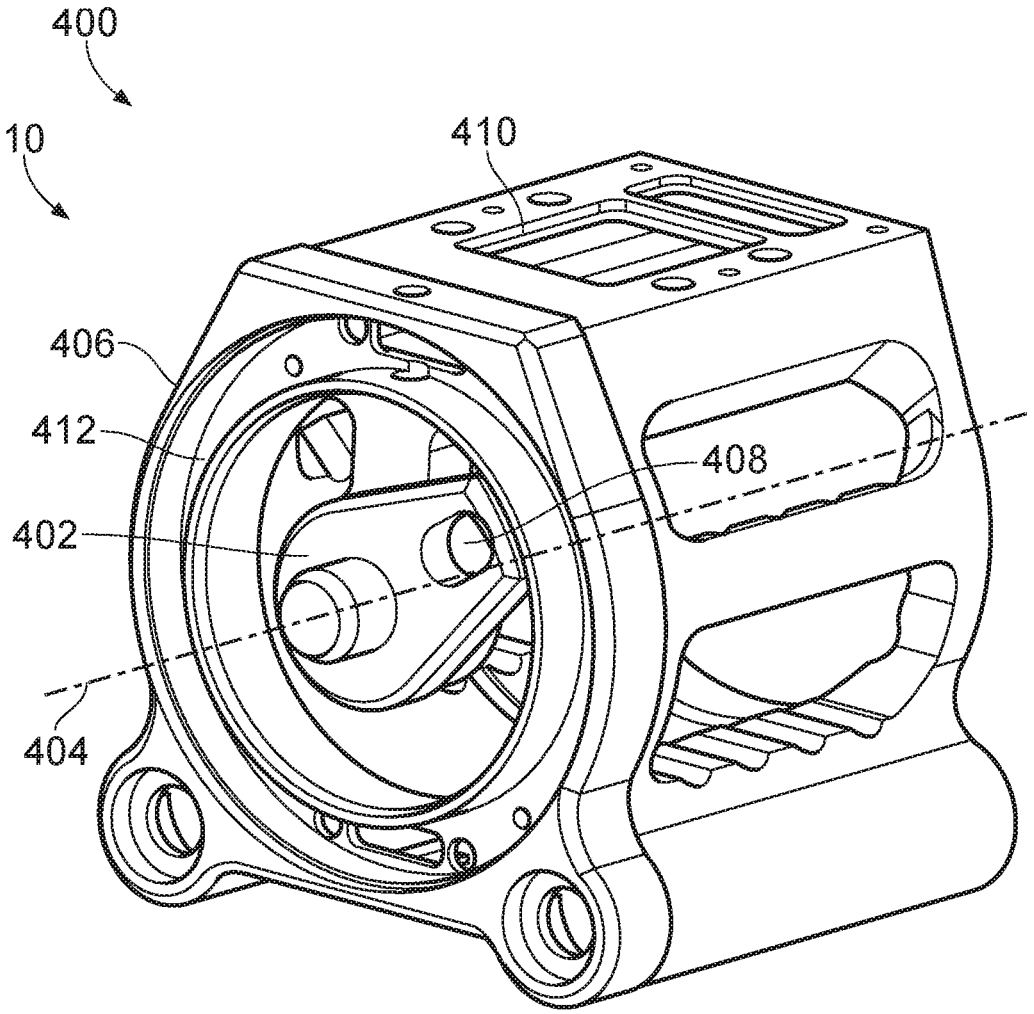
FIG. 17 is a perspective view of an eleventh embodiment of a device for guiding a user to mark a core sample.

FIG. 17 illustrates an alternative embodiment 400 of the device 10 which is similar to the previously illustrated embodiment 100, whereby common reference numerals indicate common features unless indicated otherwise.

The embodiment 400 shown in FIG. 17 includes a marking guide 402 rotatably mounted about an axis 404 defined by a housing 406. The housing 406 is shaped to partially receive the core tube 14 containing the core sample 12 such that the axis 404 is arranged to be coaxial with the longitudinal axis 13 of the core sample 12. The marking guide 402 defines an aperture 408 shaped to receive a marking implement (not shown). Rotating the guide 402 about the axis 404 repositions the aperture 408 relative to the axis 404 to allow guiding marking the core sample 12 with the implement. This allows, for example, arranging the housing 406 in a static position, such as on a bench, and about the core tube 14 and sample 12, and then rotating the guide 402 to be aligned with the marking position to allow marking the core 12. This can avoid requiring rotating the core sample 12 or the housing 406, which can be useful in restricted space environments and/or to limit physical exertion of the user.

The embodiment 400 is operable to guide the user to manually rotate the guide 403 relative to the housing 406 to align the aperture 408 with the marking position, such as by displaying instructions on a screen (not shown) mounted at a top surface 410 and/or operating light emitters (not shown) arranged about the axis 404, such as in an annular groove 412 of the housing 406. In some embodiments, the marking guide 402 is associated with a drive mechanism operable to rotate the guide 402 about the axis 404, for example, to automate rotating the guide 402 to the marking position. In some embodiments, the marking guide 402 carries a marking mechanism operable to apply a mark to the core sample 12, such as by ejecting droplets of ink, paint, or other pigment at the marking position, or applying a label or tag to the core sample 12, such as an RFID tag. The marking mechanism is configurable for manual or automatic triggering to apply the mark on the sample 12.

Returning to FIGS. 2A and 2B, in alternative embodiments (not illustrated), the marking guide structure 221 is absent and instead, the array of light emitters 40 is configured to operate to act as the marking guide 22 to indicate the location of the marking position, thereby integrating the marking guide 22 and user interface 28. For example, in one embodiment, the light emitters 40 are configured to illuminate an opposed pair of emitters 40 arranged either side of the marking position such that a line between the opposed pair coincides with the marking position. In another embodiment, the light emitters 40 are configured to illuminate at least one emitter 40 to project light to form a line which coincides with the marking position. Such embodiments may include first light emitters 40, as described above, and second, marking light emitters configured to project a plane of light and arranged to direct the plane of light, in use, towards and across the core sample 12. Such embodiments allow a user to manually mark the line on the core sample 12 thereby marking the core at the marking position.

In other embodiments (not illustrated), the marking guide structure 221 is releasably securable to the housing 102 to allow detaching from the housing 102. This may allow, for example, enhanced access to the end 18 of the core sample 12 positioned within the housing 102. This may also allow sliding the housing 102 axially relative to the core tube 14 and core sample 12. This can be useful where marking one or more locations along a side of the core tube 14 or sample 12 is required, such as by using the side marking apertures 44, discussed in greater detail below. Marking the side of the core tube 14 or core sample 12 in this way can allow, for example, transferring the marking position axially along the core tube 14 and, in some applications, sliding the device 100 between axially adjacent core tubes 14 to transfer the marking position between tubes 14. It will be appreciated that a two-part core tube 14, having axially adjacent tubes 14, may be employed when extracting the inner tube assembly in a confined, typically underground, environment.

In the illustrated embodiment 100, some of the surfaces 24 of the marking guide 221 are defined at opposed sides of an aperture, in the form of an elongate slot 42, defined by the guide 221. The elongate slot 42 is arranged to extend radially towards the central axis 35 of the aperture 34. It will be appreciated that this arrangement is exemplary and the surfaces 24 may be defined by other suitable structures, such as a single post, or pair of parallel posts. The surfaces 24 are arranged by the guide 221 to allow guiding manual movement of a marking implement, such as a pencil, crayon, pen, or scribe, across the end face 18 of the core sample 12. Typically, the surfaces 24 are spaced apart sufficiently to receive one or more specific implements. In some embodiments, such as shown in FIG. 3A, the surfaces 24 are spaced apart to allow receiving a marking insert 25 which is dimensioned to receive a specific marking implement. In such embodiments, the marking insert 25 may be interchangeable with other inserts 25 shaped to received alternative implements. In other embodiments (not illustrated) where only a single post or guide member is provided, only a single guide surface 24 is defined to act as a ruler along which a marking implement may be slid by the user to mark the core sample 12.

In some embodiments, the marking guide 22 is associated with a detector (not shown) arranged to detect presence of the marking implement adjacent the one or more surfaces 25, including within the insert 25, if present. The detector is typically in the form of an interrupter circuit and may include one or more of a light-based sensor, and a mechanical switch. The detector is communicatively coupled with the processor 30 such that responsive to the detector detecting the marking implement, the processor 30 is configured to record a marking event in the memory 32.

It will be appreciated that a wide range of marking implements are usable with the device 100 to cause marking the core sample. Typical implements include a pencil, crayon, or pen operable to apply a mark on a surface of the sample 12, a stylus or chisel operable to etch the mark into the surface, or stamp to apply or impress the mark on the surface. Other implements include a dispenser operable to spray or jet a volume of marking fluid, such as ink, or paint, to apply the mark, or dispense a volume of chemical formulation configured to degrade the core sample 12 to etch the marking into the surface. Further implements include a dispenser operable to apply a label, such as an adhesive transfer, which may carry a QR code and/or RFID circuit, to the core sample 12. It will also be appreciated that such implements may be integrated to, or fitted to and operable by, the device 10, to allow direct marking of the core sample by the device 10, as discussed further below.

The processor 30 is configurable to illuminate the light emitters 40 to indicate one or more specific positions relative to the central axis 35 of the aperture 34, such as the marking position. For example, in some applications, the processor 30 operates a first light emitter 40, adjacent the marking guide, to emit a red light, and operates a second light emitter 40, closest to the marking position, to emit a blue light. In other applications, the first light emitter 40 is operated to flash at a defined frequency, and the second light emitter 40 is operated to be constantly illuminated. Operating the light emitters 40 in this way allows the user to distinguish between the two illuminated positions and, as a result, appreciate which direction the housing 102 must be rotated to move the marking guide 22 into alignment with the marking position.

In some embodiments, the device 10 includes one or more speakers and the processor 30 is configured to operate the speaker(s) to emit sounds to guide the user to rotate the marking guide 22. Additionally or alternatively, the device 10 may include one or more vibration generators and the processor 30 be configured to operate the generator(s) to emit vibrations to guide the user to rotate the marking guide 22.

To enhance communicating the required direction of rotation to the user, the processor 30 is configurable to operate one or more of the light emitters 40 adjacent the first light emitter 40 and/or second light emitter 40 to illuminate simultaneously and/or sequentially with the first or second light emitter 40. For example, should the processor 30 determine the marking guide 22 must be rotated clockwise to be aligned with the marking position, the light emitters 40 to the right of the first light emitter 40 may be operated to sequentially illuminate towards the second light emitter 40, creating a progressively larger trail of light. Similarly, the processor 30 is configurable to operate the light emitters 40 in a specific way to confirm that the marking guide 22 is aligned with the marking position, such as pulsing a plurality of the light emitters 40 simultaneously, and/or operating a plurality of the light emitters 40 to emit a specific colour of light.

The device 100 includes a user interface device, in the form of a marking alignment button 41, operable to cause the processor 30 to store a current orientation of the device 100 in the memory 32, such as measuring and recording the orientation of the device 100 relative to a gravity vector. The button 41 is arranged to allow the user to access and press the button 41 when the marking guide 22 is aligned with the marking position. When the device orientation is recorded in the memory 32, the processor 30 is operable to communicate with the downhole tool 16, via the communications module 26, to confirm if the stored device orientation corresponds with the core orientation data stored in the memory of the downhole tool 16, providing a quality assurance function. It will be appreciated that the arrangement of the button 41 relative to the housing 102, and the form of a button, is exemplary and that the button 41 mechanism may be substituted with other suitable user interface devices, such as a capacitive switch or photo interrupter, operable by a user to cause recording a current orientation of the device 100.

FIG. 2A shows a second aspect of the user interface 28, being a screen 29 mounted on an operatively top side of the housing 102. The processor 30 is configured to operate the screen 29 to display graphics, including text, such as to provide instructions to the user to rotate the marking guide 22 to align with the marking position, or to provide other workflow instructions to guide the user using the device 100. It will be appreciated that, in some embodiments, the user interface 28 is configured so that the screen 29 is absent, and in other embodiments, the user interface is configured so that the array of light emitters 40 is absent. In embodiments where the light emitters 40 are absent, the screen 29 may be located, or arrangeable at, an end face of the housing 22, and/or be movable between a side and end of the housing 22, and be operable to display instructions, such as graphics and/or text, to guide the user to cause relative rotation of the device 100 and core sample 12 to align the marking guide 22 with the marking position.

Figure 5A:
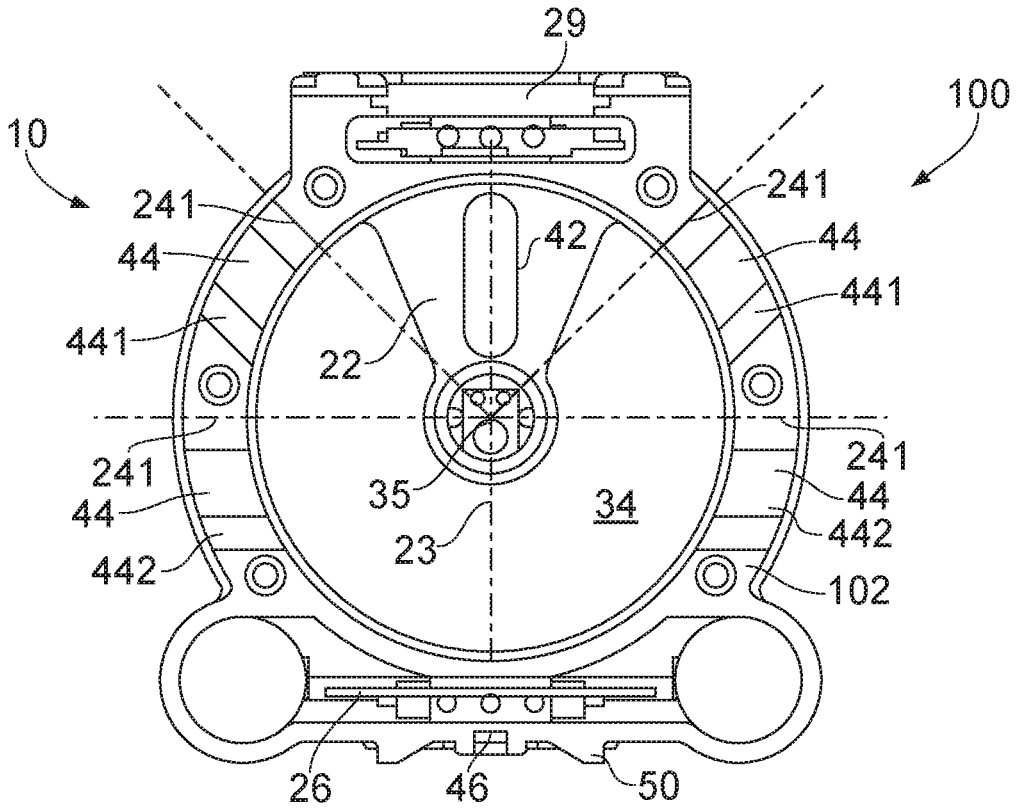
FIG. 5A is a cross-sectional end view of the device shown in the previous figures.

Best shown in FIGS. 2A and 5A, a second aspect 223 of the marking guide 22 is formed at the sides of the housing 102 to define one or more guiding surfaces 241, in this embodiment 100 the guiding surfaces defined at a side of apertures, configured as elongate slots 44, arranged to allow marking the side 15 of the core sample 12. The guiding surfaces 241 defined by the slots 44 allows marking the side of the core sample 12 should the end face 18 of the sample 12 be inaccessible or otherwise cannot be marked using the first aspect 221 of the marking guide 22. It will be appreciated that the slots 44 also allow marking a side of the core tube 14, for example, where the side 15 of the core sample 12 is inaccessible.

FIG. 5A illustrates the arrangement of the guiding surfaces 241 defined by the slots 44 relative to the central axis 35 of the aperture 34, and relative to a centre line 23 of the first aspect 221 of the marking guide 22. Each slot 44 has a guiding surface 241 arranged at a specific angle relative to the centre line 23 to act as a ruler, each guiding surface 241 indicated by a dash-dot line. First slots 441 arrange the guiding surface 241 at forty five degrees to the centre line 23, and orthogonal to the guiding surface 241 of the opposed first slot 441. Second slots 442 arrange the guiding surface at ninety degrees to the centre line 23.

Arranging the slots 44 in this way allows the user to place a marking implement through a slot 44 and slide the implement along the guiding surface 241 and the core sample 12 to mark the side 15 of the core sample 12 in one or more specific locations relative to the longitudinal axis 13 to indicate the marking position. This may allow, for example, the user to identify and mark the location of the marking position on the end 18 of the sample 12 based on the marks added to the side 15 of the sample 12. This may also allow a user to identify the marking position using the end marking guide 221 and associated light emitters 40, and add a first mark to the side of the core sample 12 or tube 14, using one of the second slots 442, at ninety degrees relative to the centre line 23. The user can then rotate the device 100 so that one of the first slots 441 is aligned with the first mark, and add a second mark, using the other side slot 441, at ninety degrees to the first mark so that the second mark is aligned with the marking position.

While FIG. 5A illustrates the guiding surfaces 241 arranged at an angle greater than zero relative to the centre line 23 of the marking guide 22, it will be appreciated that the guiding surface 241 may be arranged at a zero angle relative to the centre line 23 to be aligned with the first aspect 221 of the marking guide 22. It will further be appreciated that the angular relationship between the guiding surfaces 241 and the centre line 23 is exemplary, and that this relationship may be alternatively defined as being relative to the marking surface(s) 24 defined by the slot 42.

Figure 16A:
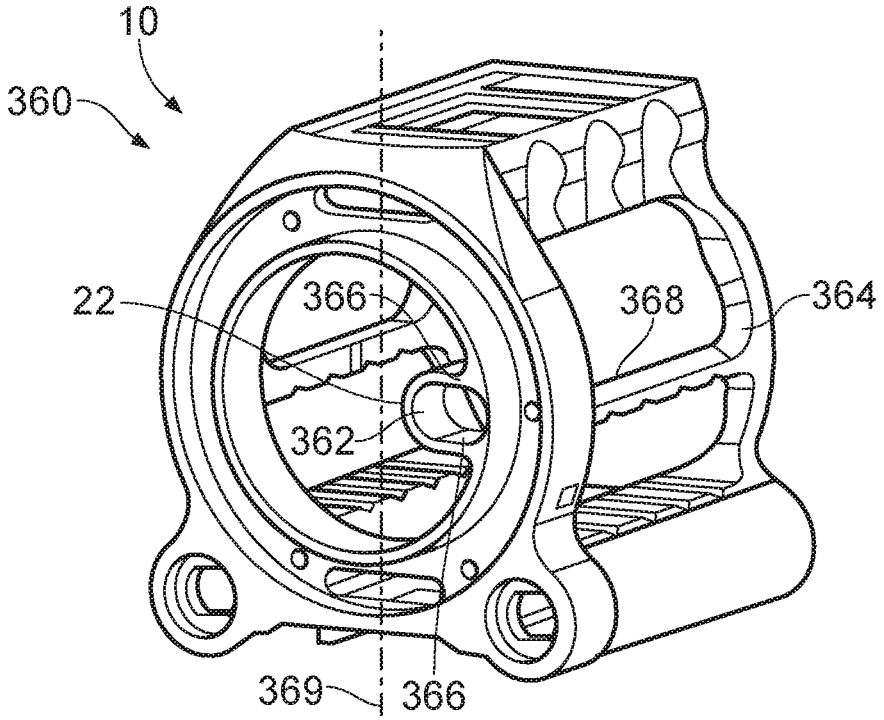
FIGS. 16A and 16B are perspective views of variations of a tenth embodiment of a device for guiding a user to mark a core sample.
Figure 16B:
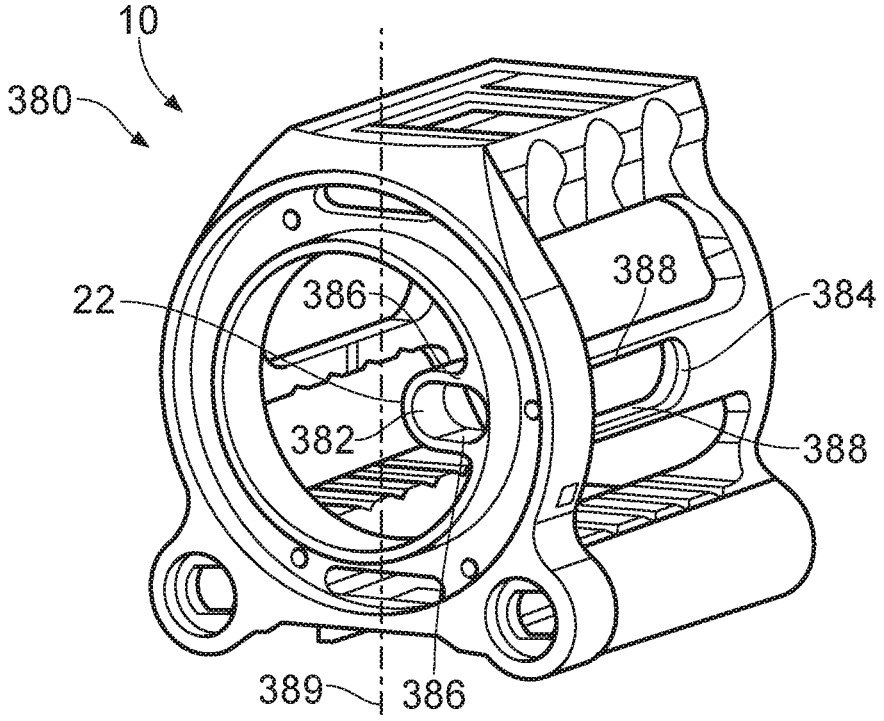

FIGS. 16A and 16B illustrate alternative embodiments 360, 380 of the device 10 which are similar to the previously illustrated embodiment 100, whereby common reference numerals indicate common features unless indicated otherwise.

The embodiment 360 shown in FIG. 16A has a marking guide 22 including an end marking aperture 362 and a side marking aperture 364. The end marking aperture 362 defines an opposed pair of end marking surfaces 366. The side marking aperture 364 defines a single side marking surface 368 aligned with one of the end marking surface 366. Each of the marking surfaces 366, 368 are arranged at an angle to an operatively vertical plane, indicated by line 369, in this embodiment 360 the marking surfaces 366, 368 arranged at 90 degrees to the plane 369. This can enhance handling the device 360 and/or accessing the marking surfaces 366, 368 during use. In this embodiment 360, the user may use one or both of the marking apertures 362, 364 to guide marking of the end and/or side of the core sample 12.

The embodiment 380 shown in FIG. 16B has a marking guide 22 including an end marking aperture 382 and a side marking aperture 384. The end marking aperture 382 defines an opposed pair of end marking surfaces 386. The side marking aperture 384 defines an opposed pair of side marking surfaces 388 aligned with the end marking surfaces 386. Each of the marking surfaces 386, 388 are arranged at an angle to an operatively vertical plane, indicated by line 389, in this embodiment 380 the marking surfaces 386, 388 arranged at 90 degrees to the plane 389. This can enhance handling the device 380 and/or accessing the marking surfaces 386, 388 during use. In this embodiment 380, the user may use one or both of the marking apertures 382, 384 to guide marking of the end and/or side of the core sample 12.

It will be appreciated that these embodiments 360, 380 may include only a single end marking surface 366, 386, in a similar way to the single side marking surface 368, such as defined by a projection or web of the marking guide 22. Also, while the end marking apertures 362, 382 and side marking aperture 384 are dimensioned to receive and/or guide one or more specific marking implements, it will be appreciated that all of the marking apertures 362, 364, 384 384 are configurable to be oversized and receive a marking aperture insert (not shown) which is dimensioned to receive and/or guide a specific marking implement, and defines the marking surfaces 366, 368, 386, 388.

The embodiments 360, 380 illustrated in FIGS. 16A and 16B can be useful where the marked core sample 12 is likely to be exposed to impacts or abrasions, such as while being withdrawn from the core tube 14, or being placed into storage, as applying marks to the end and side of the core 12 is typically more durable to surviving such impacts or abrasions.

Figure 5B:
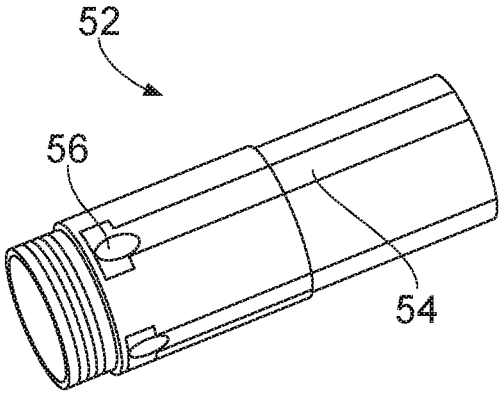
FIG. 5B is a perspective view of a grease cap typically fitted between a core tube or downhole tool for measuring core orientation, and a backend assembly.
Figure 5C:
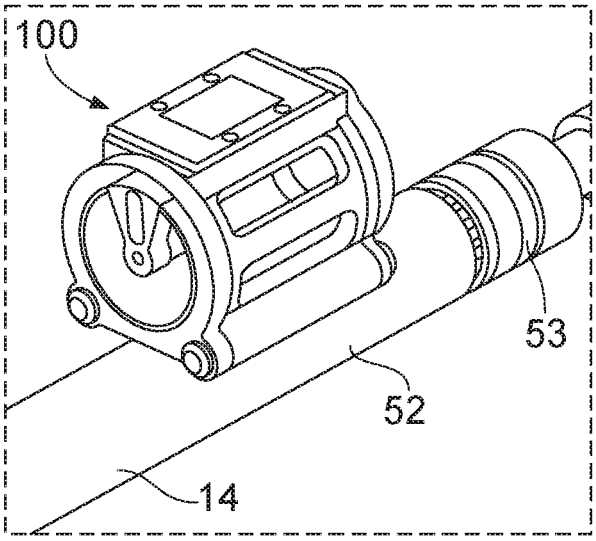
FIG. 5C is a perspective detail view of the device of the previous figures arranged on the grease cap, as shown in FIG. 5B, connected to a core tube.
Figure 10A:
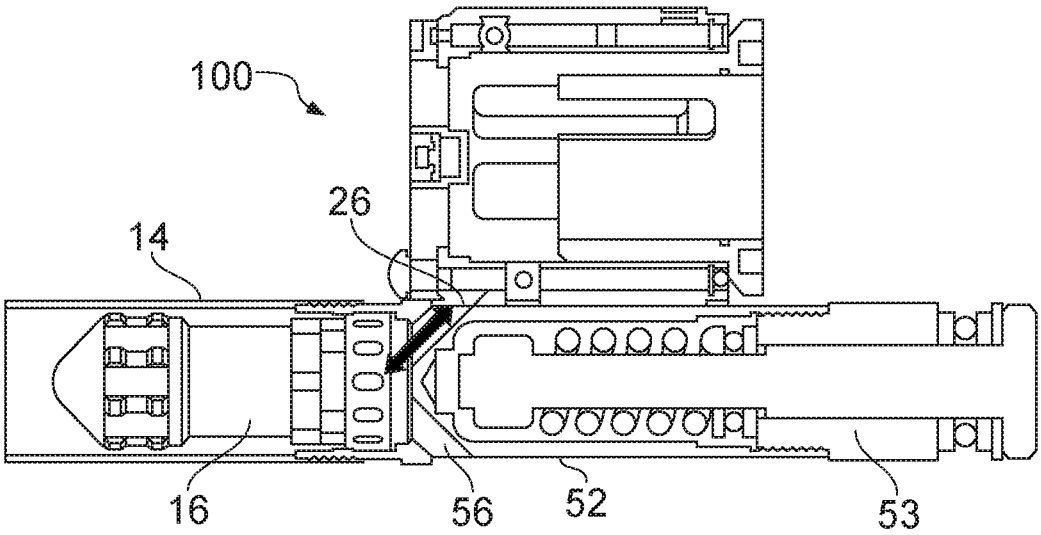
FIGS. 10A and 10B are cross-sectional side and perspective views, respectively, illustrating the device of FIGS. 1 to 5C in use communicating with a downhole tool.

Returning to FIG. 4A, this shows the underside of the housing 102 illustrating the location of a communications port 46 which defines a path to the communications module 26. In this embodiment 100, the communications module 26 is configured for optical communication, such as by emitting and receiving visible, or non-visible, light-based signals, including infrared or ultraviolet (UV) signals. The port 46 is arranged to allow the module 26 to send and receive signals external to the device 100, for example, to convey information to and from the downhole unit 16 when mounted to an external portion of the inner tube assembly as shown in FIGS. 5C and 10A. In other embodiments, the communications module 26 is configured for ultrasonic or radio frequency communications, such as according to the WiFi or Bluetooth protocol. In such embodiments, the communications port 46 may be alternatively positioned, or absent. In yet other embodiments (not illustrated), the communications module 26 is configured for direct probe contact communications, where a probe is arrangeable to abut, or connect to, the downhole tool 16.

Figure 4A:
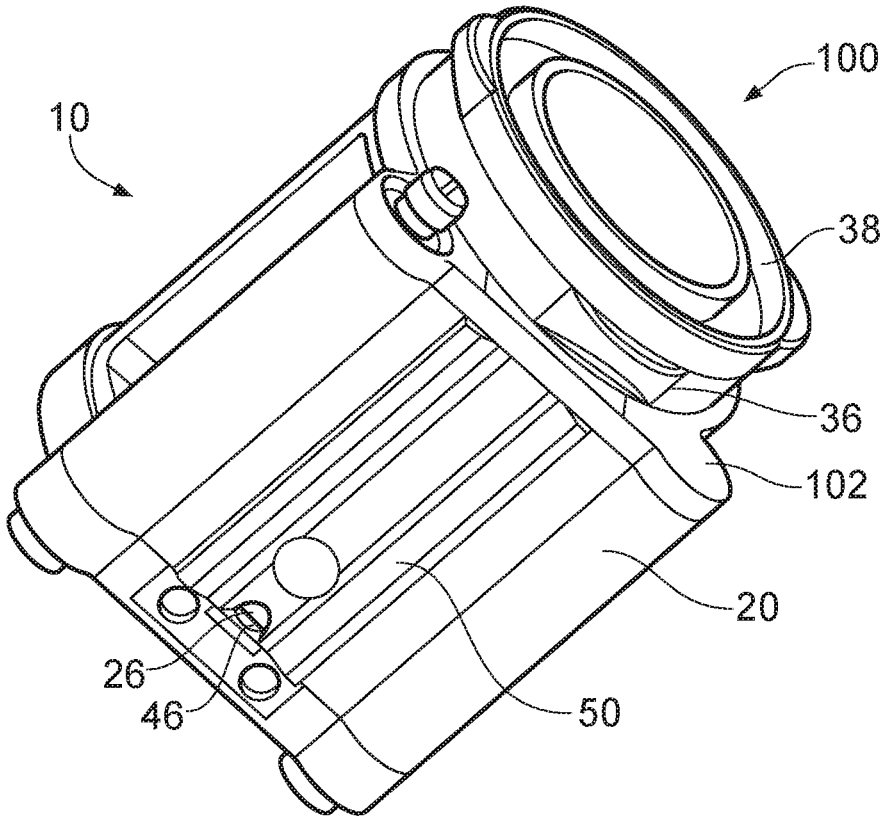
FIG. 4A is an underside perspective view of the device shown in the previous figures.
Figure 4B:
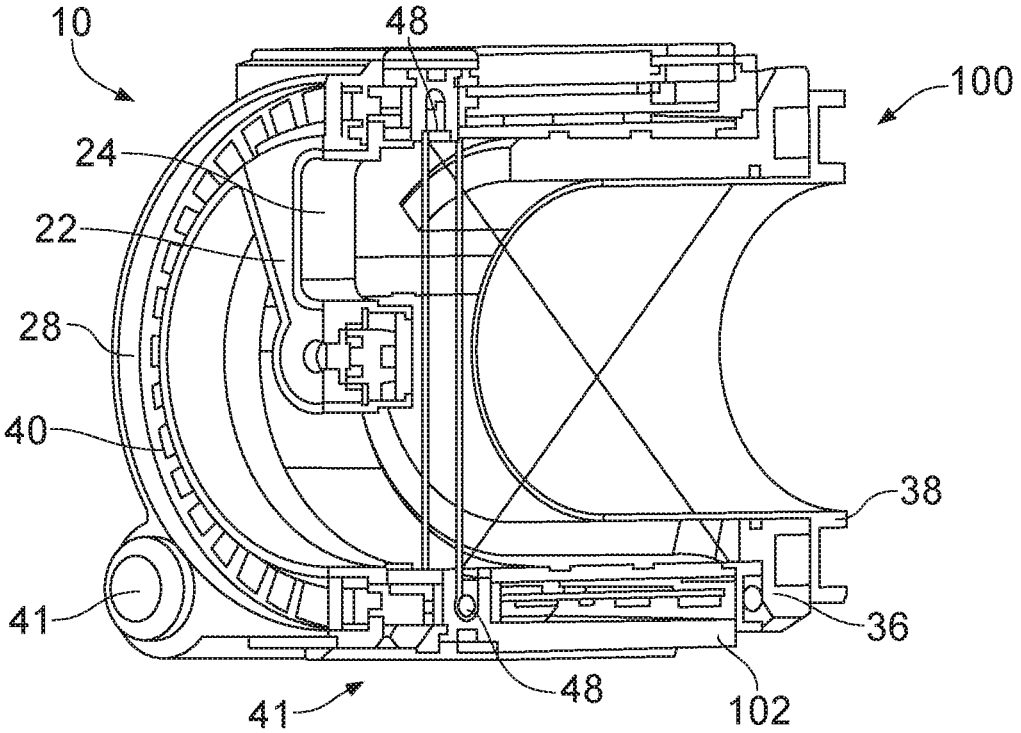
FIG. 4B is a cross-sectional perspective view of the device shown in the previous figures.

FIG. 4B shows a cross-section of the device 100 to illustrate two planar light emitters 48 being operated. The planar light emitters 48 are configured to emit a plane of light to allow projecting a line along the core sample 12 received in the housing 102. The emitters 48 are arranged to be aligned with the marking guide 22, typically being aligned with the centre line 23, so that the projected line enhances guiding the user to mark the core sample 12. The emitters 48 are mounted to the housing 102 such that one side is shielded to prevent transmission of light towards the marking guide 22, which could shine into a user's eyes when operating the device 100. The arrangement of the emitters 48 relative to the internal volume of the housing 102 means that the light does not project beyond the rim of the sleeve portion of the housing 102, and therefore inhibits transmission of light out of the aperture 34, which could also affect a user's vision. Whilst two planar light emitters 48 are shown to allow illuminating the end 18 of the core sample 12 from opposed sides, it will be appreciated that more, or less, of the emitters 48 may be included.

In some embodiments, the planar light emitters 48 are configured to cause marking of the core sample 12, such as by laser etching, or by activating a pigment or dye applied to the core sample 12 to cause colouration or polymerisation of the pigment or dye. For example, a UV light curable liquid polymer or activator may be applied to the core sample 12 prior to inserting into the housing 12, and the light emitters 48 include UV lamps operable to cause curing of the polymer to adhere to the core sample 12 and indicate the location of the marking position. In such embodiments, the planar light emitters 48 may be rotatably mounted to the housing 102 and movable by operating a drive mechanism such that the processor 30 is configured to control rotational position of the light emitters 48, and operate the emitters 48, to mark the marking position on the core sample 12, thereby automating core marking. It will be appreciated that in such embodiments, the marking guide 22 and user interface 28 may be absent.

FIG. 5A illustrates a key structure 50 extending from the underside of the housing 102. The key structure 50 is shaped and dimensioned to engage with a corresponding structure defined by a component of the inner tube assembly to allow mounting on the component. For example, as shown in FIG. 5B, a non-standard grease cap 52 is configured to define an axially extending channel 54 associated with each water port 56, and the key structure 50 is configured to fit within the channel 54 to slidably engage the housing 102 to the grease cap 52. This engagement allows sliding the housing 102 relative to the grease cap 52 to reach an end of the channel 54, providing positive, haptic feedback to the user that the housing 102 is in position for communication with the downhole tool 16. In some embodiments, complementary magnets may be arranged adjacent the channel 54 and the key structure 50 to enhance retaining the housing 102 in this position and provide firm, haptic feedback to the user.

When the device 100 is arranged such that the key structure 50 is engaged with and at the end of the channel 54, the communications port 46 is aligned with the water port 56 to allow signals to be transmitted to, and received from, an internal, unsealed region of the grease cap 52. As shown in FIG. 5C, the grease cap 52 is typically mounted to an upper, threaded end (uphole) of the downhole unit 16, between the core tube 14 and a backend assembly 53. In this arrangement, the downhole unit 16 is a component of the core tube assembly, and the water port 56 of the grease cap 52 is positioned to allow access to a communications module at an uphole end of the downhole unit 16, such as shown in FIG. 10A. The channel of the grease cap 53 therefore may allow axial guidance and/or alignment with the device 100, as well as alignment of the communications module 26 of the device 100 and the communications module of the downhole unit 16. It will be appreciated that configuring the key structure 50 to fit to the grease cap 52 is exemplary, and that the key structure 50 is configurable to fit to other components of a downhole assembly, and communications to be transmitted via other conduits defined by such components.

FIGS. 6A to 6G illustrate various stages of a scheme for operating the array of light emitters 40 to guide a user to rotate the marking guide 22 to align with the marking position. To enhance clarity, these figures show only the slot 42 of the marking guide 22 and the array of light emitters 40. It will be appreciated that the stages of operation are programmed into the processor 30 to cause operating the emitters 40 as illustrated.

Figure 6A:
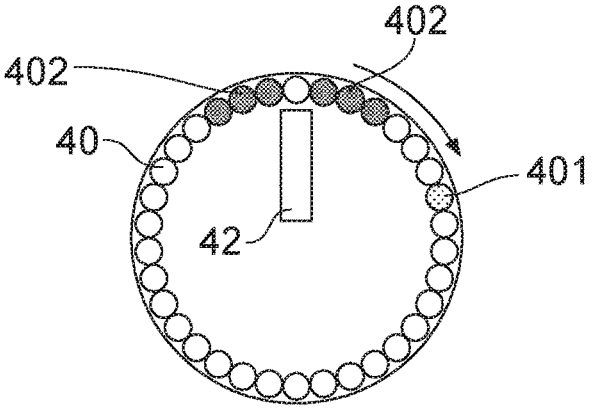
FIGS. 6A to 6G are schematic views illustrating stages of operation of the user interface of the device shown in the previous figures.

FIG. 6A shows a first light emitter 401 illuminated a first colour or intensity, the first emitter 401 indicating the location of the marking position about the axis 13 of the core sample 12. Second light emitters 402 are illuminated a second colour or intensity, the second emitters 402 indicating the location of the slot 42. Three second emitters 402 are illuminated at either side of the slot 42.

Figure 6B:
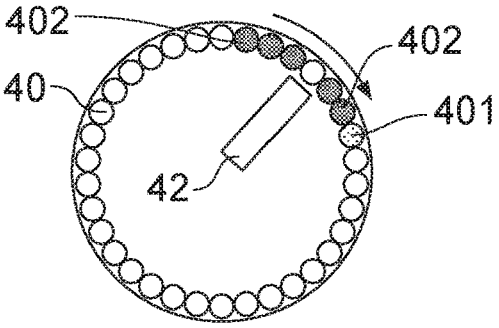
Figure 6C:
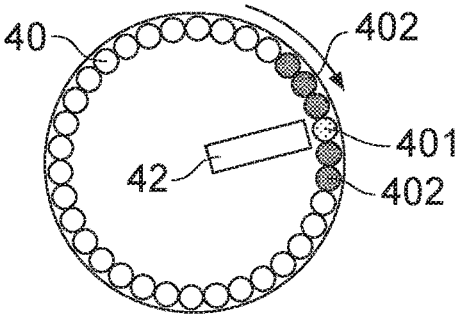

FIG. 6B shows the slot 42 being rotated clockwise, towards the marking position, typically caused by rotating the housing 102. FIG. 6C shows the slot 42 being approximately aligned with the marking position. In this embodiment 100, each light emitter 40 represents ten degrees of rotation, and therefore at this stage the slot 42 is within +/− five degrees of the marking position. FIG. 6C shows one of the second light emitters 402 to the right of the slot 42 has been deactivated, indicating the user must now fine tune the slot 42 alignment by slowly rotating the slot 42 clockwise.

Figure 6D:
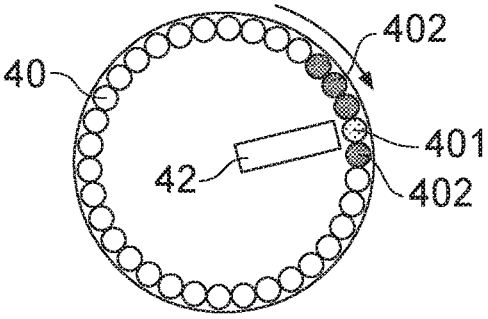
Figure 6E:
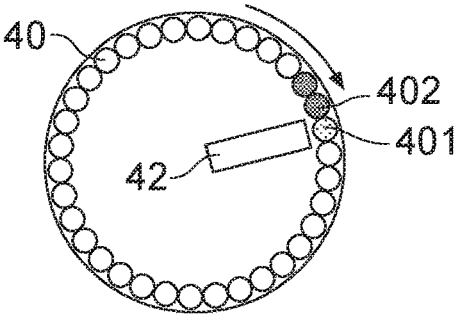

FIGS. 6D and 6E show second light emitters 402 to the right of the slot 42 being progressively deactivated as the slot 42 continues to be rotated clockwise.

Figure 6F:
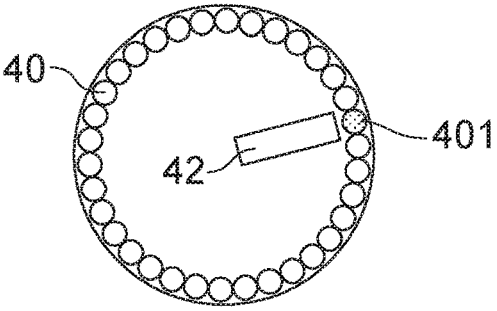

FIG. 6F shows the slot 42 in precise alignment with the marking position, causing illumination of all of the light emitters 40. This may involve illuminating all, or only some of the emitters 40, a specific colour and/or emitting a specific flash sequence.

Figure 6G:
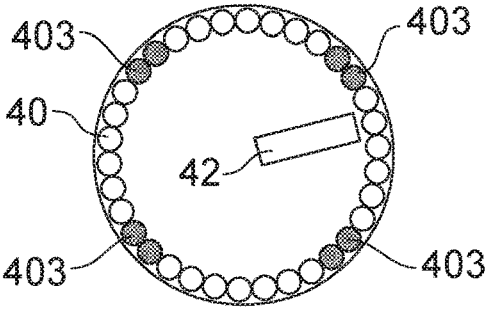

FIG. 6G shows four pairs of the light emitters 403 being illuminated to indicate an error, such as loss of alignment of the slot 42 and the marking position.

Figure 8:
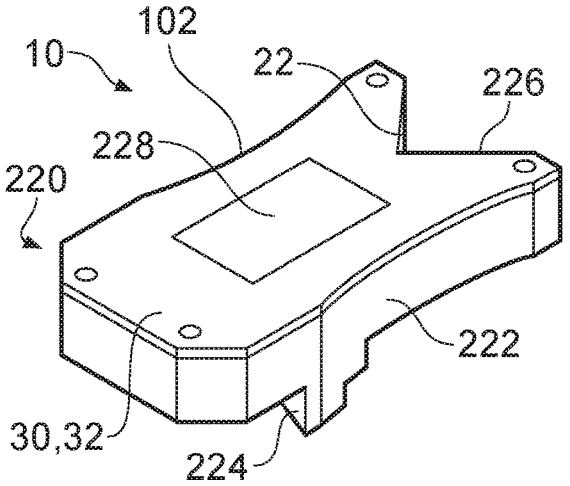
FIG. 8 is a perspective view of a third embodiment of a device for guiding a user to mark a core sample.

FIGS. 7 to 9 illustrate alternative embodiments 200, 220, 240 of the device 10. It will be appreciated that reference numerals common to the first described embodiment 100 indicate common features, unless indicated otherwise.

The embodiment 200 shown in FIG. 7 has a housing 202 shaped to be placed on a side of the core tube 14. The housing 202 defines a pair of opposed contact portions, configured as inclined and substantially planar abutment regions 204 arranged to form a V-shaped structure to receive the side of the core tube 14. The abutment regions 204 are arranged to be spaced apart and at an obtuse angle to each other, in the illustrated embodiment 200 being arranged at 120 degrees, so that the housing 202 is mountable on a wide range of diameters of core tubes 14. In some embodiments, the abutment regions 204 carry, or are associated with, magnets to allow drawing the housing 202 to the core tube 14, which may allow suspending the housing 202 from the tube 14. It will be appreciated that the abutment regions 204 may be alternatively configured, such as defining curves, to allow receiving the side of the core tube 14. Arranging the abutment regions 204 against the tube 14 allows rotation of the housing 202, and consequently rotation of the marking guide 22, about the axis 13 of the core sample 12.

The marking guide 22 of this embodiment 200 is slidably engaged with the housing 202 to allow being extended from the housing 202 and across the end 18 of the core sample to guide marking, and be retracted at least partially into the housing 202 when not in use. In some embodiments, the marking guide 22 is configured to be releasably engaged with the housing 202, such as to allow replacement. The marking guide 22 is configured in substantially the same way as described above, including defining the elongate slot 42 shaped to receive a marking implement. In other embodiments (not illustrated), the body defining the slot 42 is substituted with a post, or other elongate member, slidably or pivotably engaged with the housing 202 to allow moving between a storage and use position. It will be appreciated that the marking guide 22 of this embodiment 200 may be configured to receive the marking insert 25 to adjust a width of the slot 42, as described above.

The housing 202 carries a display 206 configured to be operable, by the processor 30, to display graphics, including text, relating to the marking position, and typically also show a graphical indication of the marking guide 22 relative to the marking position. The housing 202 arranges the display 206 so that, in use, the display 206 extends radially relative to the axis 13 of the core sample 12.

The embodiment 220 shown in FIG. 8 has a housing 222 shaped to be placed on a side of the core tube 14. The housing 222 defines a pair of opposed contact portions in the form of inclined abutment regions 224 arranged to form a V-shaped structure to receive the side of the core tube 14. In some embodiments, the abutment regions 224 carry, or are associated with, magnets to allow drawing the housing 222 to the core tube 14, which may allow suspending the housing 222 from the tube 14. Arranging the abutment regions 224 against the tube 14 allows rotation of the housing 222, and consequently rotation of the marking guide 22, about the axis 13 of the core sample 12.

The marking guide 22 of this embodiment 220 is in the form of a profile 226 defined by the housing 222. This configuration allows placing the housing 22 against or alongside a side of the core tube 14 or core sample 12 such that the profile 226 can guide marking the side 15. This configuration allows moving the device 220 axially relative to the core tube 14 or core sample 12 to mark the side at a plurality of locations, such as to transfer the marking position along the tube 14 or core sample 12, and between axially adjacent core tubes 14. The profile 226 defines another pair of opposed inclined surfaces to form a V-shaped notch shaped to receive a marking implement.

The housing 222 carries a display 228 which is operable, by the processor 30, to display graphics, including text, relating to the marking position, and typically also show a graphical indication of the marking guide 22 relative to the marking position. The housing 222 arranges the display 228 so that, in use, the display 228 extends parallel relative to the axis 13 of the core sample 12.

The embodiment 240 shown in FIG. 9 has a housing 242 which is releasably engageable to the marking guide 22, in this embodiment 240 in the form of a core tube clip 244. The clip 244 is shaped to be placed on a side of the core tube 14 to partially surround the tube 14. The clip 244 is typically dimensioned for a standard core tube size (diameter), and may be interchanged with other clips 244 dimensioned to fit another standard core tube size. The clip 244 defines one or more curved receiving surfaces 246 arranged to form a C-shaped structure to receive the side of the core tube 14. It will be appreciated that the receiving surface(s) 246 may be alternatively configured, such as defining a plurality of discontinuous surfaces, such as formed by radially extending fins, to allow receiving the side of the core tube 14. Arranging the receiving surfaces 246 against the tube 14, and connecting the housing 242 to the clip 244, allows rotation of the housing 242, and consequently rotation of the marking guide 22, about the axis 13 of the core sample 12.

The marking guide 22 of this embodiment 240 is integrally formed with the clip 244 to allow being arranged across the end 18 of the core sample to guide marking when the clip 244 is mounted to the core tube 14. The marking guide 22 is includes an open-ended slot 248 shaped to receive a marking implement. In other embodiments (not illustrated), the portion of the clip 244 defining the slot 248 is configured as a single post, to define a marking surface. It will be appreciated that the marking guide 22 of this embodiment 240 may be configured to receive the marking insert 25 to adjust a width of the slot 246, as described above.

The housing 242 carries a display 250 which is operable, by the processor 30, to display graphics, including text, relating to the marking position, and typically also show a graphical indication of the marking guide 22 relative to the marking position. The housing 242 is securable to the clip 244 in different orientations to allow arranging the display 250 to extend radially or parallel relative to the axis 13 of the core sample 12.

Figure 10B:
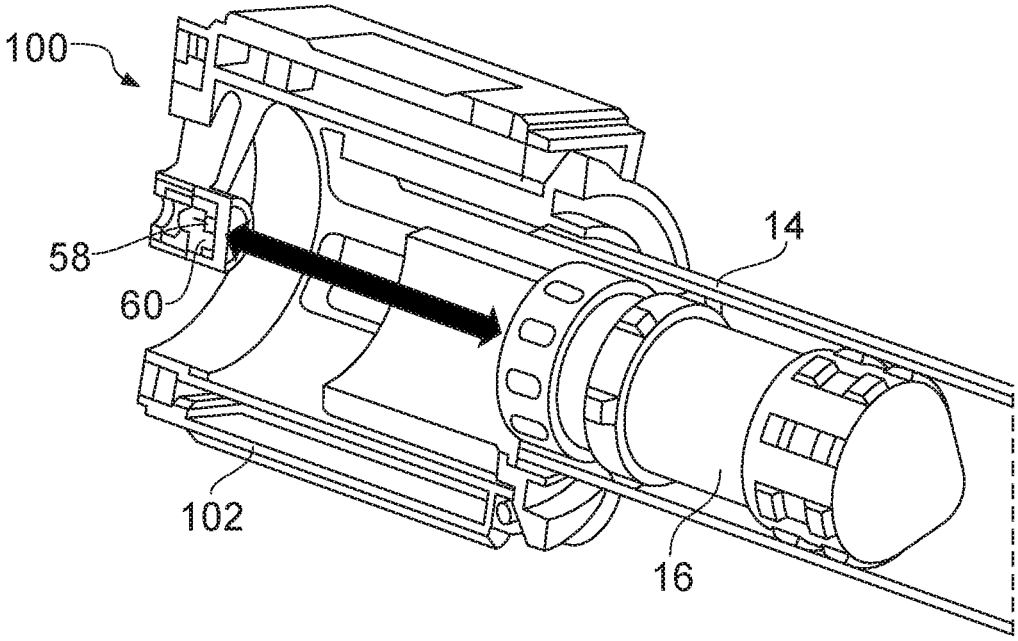

FIGS. 10A and 10B illustrate the device 100 being operated to communicate with the downhole tool 16 in two different configurations, whereby the double-ended arrows indicate communication of signals between the device 100 and the downhole tool 16. FIG. 10A shows a first mode of communications where the tool 16 remains connected (tooled) to adjacent components of the downhole assembly, such as the core tube 14 (downhole) and grease cap 52 (uphole). FIG. 10B shows a second mode of communications where the tool 16 is disconnected (de-tooled) from uphole components, such as the grease cap 52 and the backend assembly 53. While FIGS. 10A and 10B show the first embodiment 100 of the device in operation, it will be appreciated that any of the other described embodiments 200, 220, 240 are configurable to communicate with the downhole unit 16 in this way.

As described above, the communications module 26 and communications port 46 defined in the housing 102 are arranged to allow communication with the downhole tool 16 when mounted to the sidewall of a component of the downhole assembly, such as the grease cap 52 shown in FIG. 10A. This mode of communication involves directing signals through a conduit to the downhole unit 16, typically via an angled water port 56. This can be advantageous as this allows extracting data without de-tooling the downhole unit 16. This can advantageously avoid a user inadvertently rotating the threaded engagement between the core tube 14 and the tool 16, which can cause relative rotation between the tube 14 and the tool 16 to void the orientation data recorded by the tool 16. When operated to communicate with the downhole unit 15 in this way, this may cause the screen 29 to be operated, by the processor 30, to display graphics relating to a first workflow.

In some embodiments, such as illustrated in FIG. 10B, the device 100 includes a second communications module 58 arranged within the sleeve portion to face towards the open end of the housing 102. The second communications module 58 is operable to communicate directly with an exposed face of the downhole unit 16 when disconnected from uphole components. When operated to communicate with the downhole unit 16 in this way, this may cause the screen 29 to be operated, by the processor 30, to display graphics relating to a second workflow.

The device 10 is operable to communicate with the downhole tool 16 to convey and receive orientation information, such as receiving core orientation data to allow determining the marking position, and/or transmitting orientation data to allow determining a relationship between a marked, recorded position, stored in the memory of the device 10, and the core orientation data. The device 10 may also be operable to communicate with the downhole tool 16 to receive tool identification data, for example, a serial number, such as to allow determining an appropriate workflow for the specific tool 16.

The embodiment 100 as shown in FIG. 10B may include an imaging module, in this embodiment being an optical camera 60, mounted to the housing 102, adjacent the second communications module 58, to allow capturing an image of the end 18 of the core sample 12 when arranged in the housing 102. Whilst this embodiment includes a single camera, it will be appreciated that a plurality of cameras operable to generate an image based on visible and/or non-visible light, such as infrared light, may be provided, and/or a three-dimensional scanner operable to generate a three-dimensional model of the end 18 and/or side 15 of the core sample 12. It will also be appreciated that one or more imaging modules may be provided at alternative locations, such as to be adjacent the side 15 of the core sample received in the housing 102.

The imaging module(s) may allow recording core sample 12 reference information for quality assurance purposes, two or three-dimensional mapping of the end face 18 of the core sample 12 based on the unique face pattern caused by breaking the core sample 12 from the bedrock, and/or virtual marking of the core 12, where the image, or model, is marked with the marking position determined by the processor 30. Such embodiments can advantageously allow linking an image/model generated with the imaging module(s) with orientation data measured by the device 10, such as defining rotational position relative to the central axis 35, and a time stamp. Connecting data in this way can enhance confidence in the accuracy of transferring the core orientation data recorded by the downhole tool 16 to the core sample 12.

As described above, the device 10 is configurable to determine the marking position, based on the data received from the tool 16, and directly mark the core sample 12 to indicate the marking position. In such embodiments, the device 10 may include: the housing 20 mountable relative to the core sample 12 or the core tube 14; a marking system carried by the housing 20 and operable to mark at least one of the end 18 and side 15 of the core sample 12 at one or more positions; the communications module 26 operable to communicate with the downhole tool 16 to receive the data;

and the processor 30 and memory 32, the processor communicatively coupled to the marking system and the communications module 26, and configured to store the data in the memory 32, the processor 30 further configured to determine a marking position based on the data, and operate the marking system to mark the core sample 12 at the marking position.

In this embodiment, the marking system is configurable to comprise a range of mechanisms operable to cause placing a mark in one or more locations on the core sample 12. For example, the marking system may include one or more of a mechanised pen, crayon, scribe, pigment applicator, stamp, or the like, which is controllably operable, typically being movable relative to the housing 20, to mark the core 12, and/or may include one or more light emitters operable to emit visible or non-visible light to mark the core 12, such as by burning the core 12 or activating a pigment applied to the core 12 to mark the core 12.

The marking system may be statically mounted to the housing 20 and be operable to adjust its direction, such as by angling a lens, to direct the placement of the mark. The marking system may instead be movable relative to the housing 20 to allow accessing and marking the core sample 12 at the marking position. Furthermore, the housing 20, or a portion thereof, may be configured to allow rotation about the longitudinal axis 13, and the device 300 include a translation mechanism operable to rotate one of the marking system and the housing 20, or the portion of the housing 20, about the core sample 12 or the core tube 14 such that the marking system is arranged in a defined position relative to the marking position to allow operating the marking system to mark the core sample 12. Alternatively, the housing 20 may be configured for static mounting and the device 10 be operable to guide rotation of the core sample 12, such as by operating the user interface 28, relative to the housing 12 until causing operation of the marking system to mark the core sample 12 at the marking position.

In some embodiments, the device 10 is configurable to determine the marking position, based on the data received from the tool 16, and generate virtual marking information to identify the marking position on the end 18 and/or side 15 of the core sample 12. In such embodiments, the device 10 may include: the housing 20 mountable relative to the core sample 12 or the core tube 14; an imaging system carried by the housing 20 and operable to generate a digital representation of a portion of the core sample 12; the communications module 26 operable to communicate with the downhole tool 16 to receive the data; and the processor 30 and memory 32, the processor communicatively coupled to the imaging system and the communications module 26, and configured to store the data in the memory 32, where the processor 30 is further configured to determine a marking position based on the received data, and manipulate the digital representation of the core sample 12 to identify the marking position.

In such embodiments, the imaging system may comprise one or more optical cameras operable to generate a two-dimensional image of the core sample 12. Alternatively or additionally, the imaging system may comprise a three-dimensional scanner operable to generate a three-dimensional model of a portion of the core sample 12. It will be appreciated that the imaging system may comprise a combination of different imaging mechanisms, such as a sensor array configured to generate an RGB-D image, including visible light and depth information, such as relating to the surface profile of the end 18 of the core sample 12.

FIGS. 11A to 18D illustrate alternative embodiments 260, 280, 300, 320, 340, 360, 380, 400, 420 of the device 10. It will be appreciated that reference numerals common to the previously described embodiments 100, 200, 220, 240 indicate common features, unless indicated otherwise.

Figure 11A:
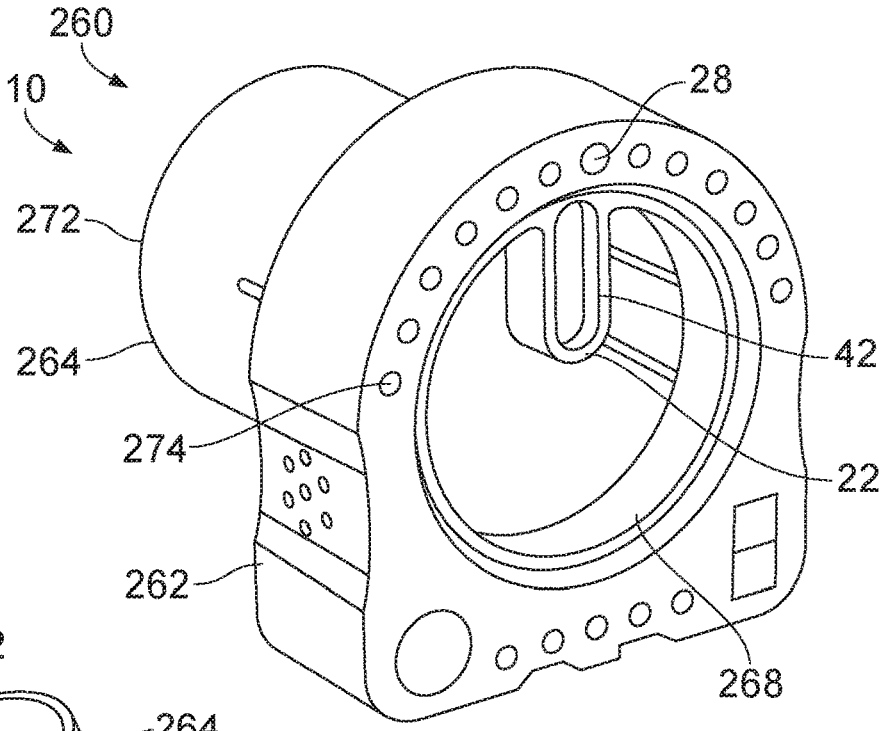
FIGS. 11A to 11C are perspective views of a fifth embodiment of a device for guiding a user to mark a core sample.
Figure 11B:
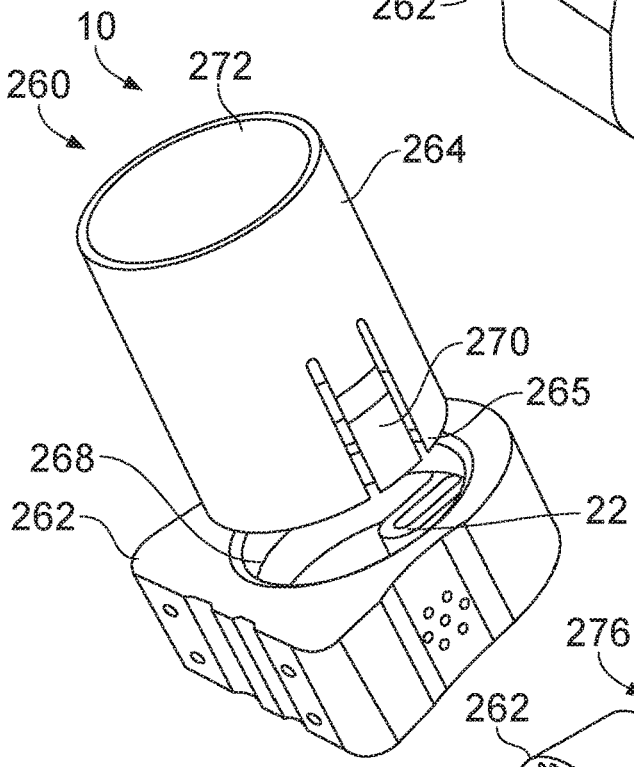
Figure 11C:
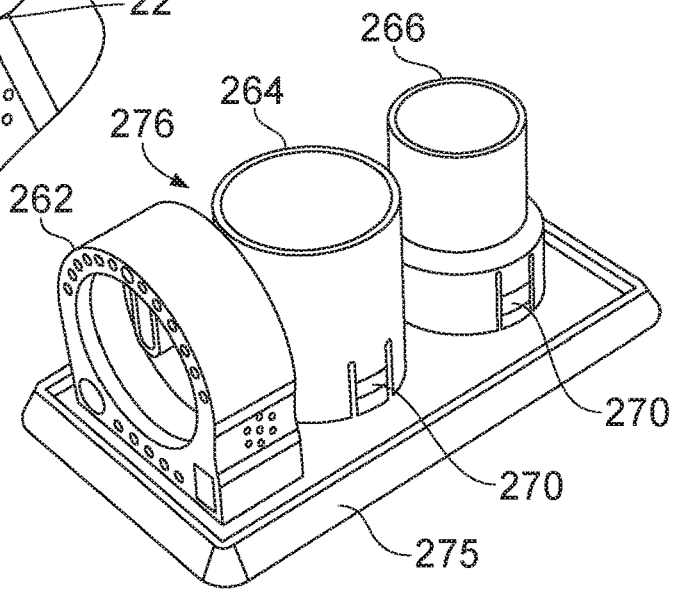

The embodiment 260 shown in FIGS. 11A to 11C has a housing 262 mountable to the core tube 14 via one of a range of adaptors 264, 266. The housing 262 defines a recess 268 to receive a first end of an adaptor 264, 266. In this embodiment 260, the first end 265 of each adaptor 264 includes an engagement mechanism, in the form of opposed resiliently depressible tabs 270, which is readily securable to the housing 262 within the recess 268. It will be appreciated that, in other embodiments, the housing 262 carries or forms and engagement mechanism for engaging the adaptor 264, 266. A second, opposed end 272 of each adaptor 264, 266 defines a contact portion dimensioned to receive and abut a specific core tube size, in the same way as the sleeve adaptors 36, 38 described above. Each end 265, 272 of each adaptor 264, 266 is configured to form a substantially continuous cylindrical tube. It will be appreciated that at least the second end 272 is configurable to define other forms, such as to reduce friction between the adaptor 264, 266 and the core tube 14. For example, the second end 272 may include a plurality of splines, ribs or dimples to provide the contact portions for abutting the core tube 14.

The marking guide 22 of this embodiment 260 is integrally formed with the housing 262 to extend radially relative to the recess 268. The marking guide 22 is configured in substantially the same way as described above, including having marking surfaces defined at opposed sides of an elongate slot 42, and the slot 42 is dimensioned to receive a marking implement. As described above, it will be appreciated that the marking surfaces of the marking guide 22 may be defined by other structures, such as one or more posts mounted to the housing 262.

The guide 22 is associated with an aspect of the user interface 28 being an arc-shaped array of light emitters 274 mounted at an end face of the housing 262 to be arranged partially about the recess 268. The emitters 274 are configured to be selectively operable, in some embodiments being sequentially operated, by the processor 30, to indicate the direction of relative rotation necessary to align the marking guide 22 with the marking position, and to confirm the marking guide 22 is aligned with the marking position, such as by indicating when the marking guide 22 is within a tolerance distance from the marking position. It will be appreciated that the array of light emitters 274 is alternatively configurable to include more, or less emitters 274, including only two emitters 274, and may be arranged as a linear array. Furthermore, the array of light emitters 274 may be substituted with a single light emitter 274 configured to operate in different ways to indicate the direction of relative rotation required to align the marking guide 22 with the marking position, such as emitting different colour, intensity, and/or pulse frequency light.

FIG. 11C shows the housing 262 and the pair of adaptors 264, 266 received in a tray 275, such as to allow shipping to the user, and/or storage, as a kit 276. It will be appreciated that the kit 276 may be alternatively configured to have more, or less, adaptors 264, 266 and that each adaptor 264, 266 may be alternatively shaped and/or dimensioned to fit to alternative core tubes 14. For example, in some embodiments, the kit 276 includes a plurality of first adaptors 264 and a plurality of second adaptors 266 to provide spare parts should one of the adaptors 264, 266 be broken or lost.

Figure 12A:
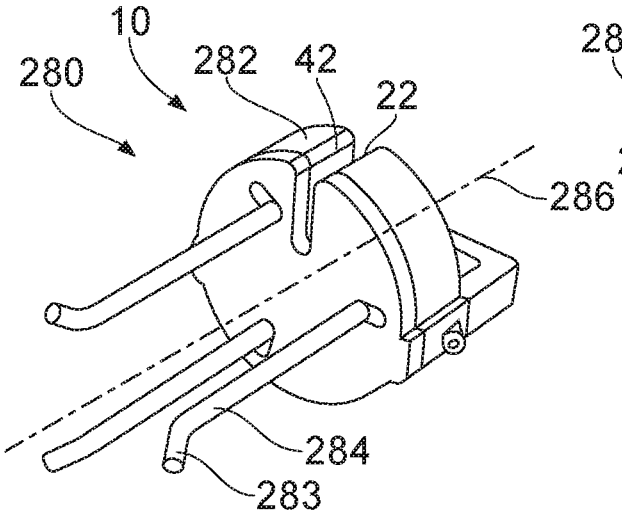
FIGS. 12A and 12B are perspective views of sixth embodiment of a device for guiding a user to mark a core sample.
Figure 12B:
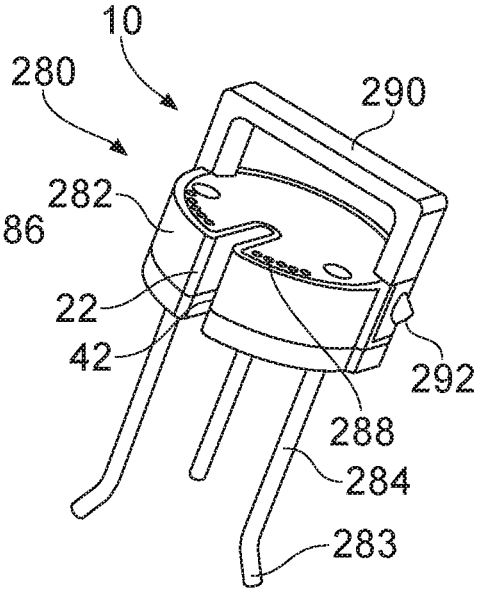
Figure 12C:
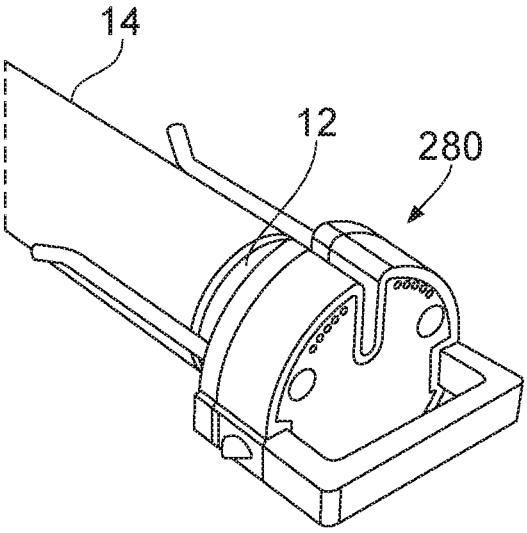
FIGS. 12C and 12D are perspective views of the embodiment shown in FIGS. 12A and 12B in use, arranged relative to a core tube and grease cap, respectively.

The embodiment 280 shown in FIGS. 12A to 12D has a housing 282 mountable to the core tube 14 via gripping by three elongate mounting members, in the form of legs 284, each defining a contact portion. The legs 284 extend perpendicularly away from an end face of the housing 282 and are movable mounted to the housing 282 to be biased radially towards a central axis 286 of the housing 282. Each leg 284 may include a magnetic portion to cause drawing the leg 284 towards the core tube 14. In this embodiment, each leg 284 define a lead-in portion 283 arranged to guide receiving the core tube 14 and/or core sample 12 within the array of legs 284. As illustrated in FIG. 12C, the configuration of the legs 284 allows the legs 284 to be radially displaced away from the axis 286 to mount the device 280 to a range of core tubes 14 having different sidewall diameters, as well as guiding positioning of the housing 282 such that the housing axis 286 is centralised to the axis 13 of the core sample 12 contained in the tube 14.

The marking guide 22 of this embodiment 280 is integrally formed with the housing 282 to extend radially relative to the axis 286. The marking guide 22 is configured in substantially the same way as described above, including having marking surfaces defined at opposed sides of an elongate slot 42, and the slot 42 being dimensioned to receive a marking implement. The slot 42 is configured to extend through and partway across the housing 282 to be in-board of the housing periphery. It will be appreciated that, in other embodiments, the housing 282 is configurable to define a more compact peripheral profile and that the slot 42 be defined by one or more members extending from the housing 282 such that the slot 42 is at least partially outside of the periphery.

The guide 22 is associated with an aspect of the user interface 28 being a plurality of light emitters 288 mounted at an end face of the housing 282 to be arranged in an arc-shaped array at each side of the slot 42. The emitters 288 are configured to be selectively operable, in some embodiments being sequentially operated, by the processor 30, to indicate the direction of relative rotation necessary to align the marking guide 22 with the marking position, and to confirm the marking guide 22 is aligned with the marking position.

Figure 12D:
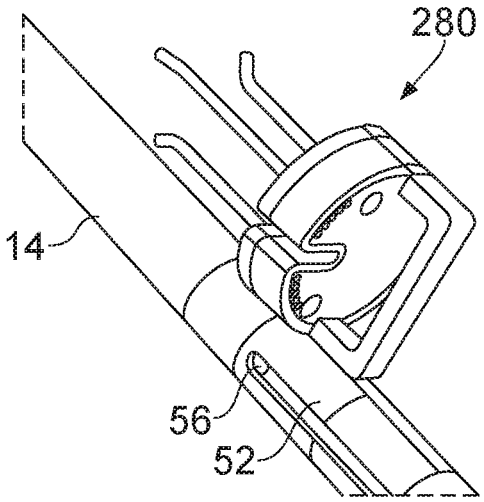

Best shown in FIG. 12B, the device 280 includes a carry handle 290 mounted to, or integrally formed with, the housing 282. In some embodiments, the handle 290 is releasably engaged with the body 282. A port 292 is arranged at one side of the body 282, the port 292 defining a signal path to the communications module 26 arranged within the housing 282. As illustrated in FIG. 12D, the port 292 is shaped to fit to the downhole assembly, such as by mating with one of the water ports 56 of the grease cap 52, to allow communication with the downhole unit 16. In this embodiment 280, the port 292 is fixedly positioned at a defined angle relative to the axis 286 of the housing 282 such that when a side of the housing 282 and/or handle 290 is placed against a sidewall of the grease cap 52, the port 292 is aligned with the axis of the water port 56 to optimise sending and receiving signals through the water port 56. In other embodiments (not illustrated), the port 292 is pivotable, or otherwise movable, relative to the housing 282, such as to allow adjusting its angle relative to the housing 282 and/or retracting the port 292 within the housing 282 to a storage position.

Figure 13A:
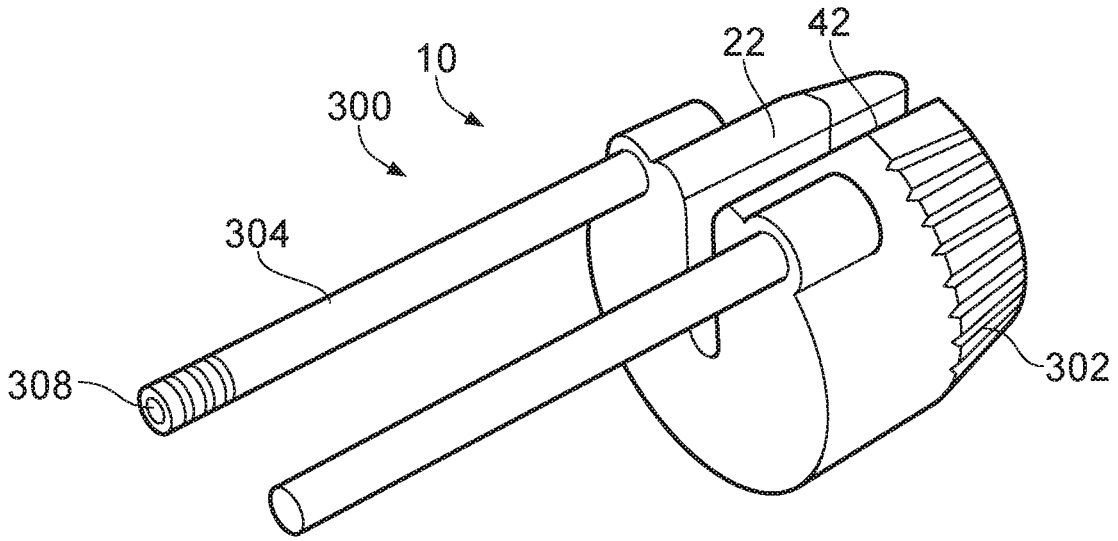
FIG. 13A is a perspective view of a seventh embodiment of a device for guiding a user to mark a core sample.
Figure 13B:
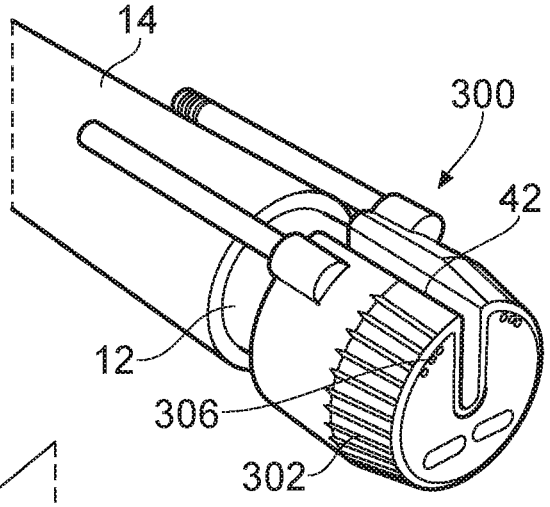
FIGS. 13B and 13 are perspective views of the embodiment shown in FIG. 13A in use, arranged relative to a core tube and grease cap, respectively.
Figure 13C:
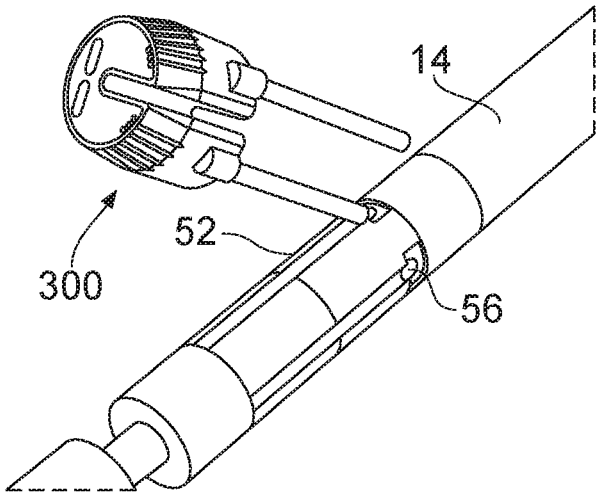

The embodiment 300 shown in FIGS. 13A to 13C has a housing 302 mountable to the core tube 14 via a pair of elongate mounting members, in the form of posts 304, each defining a contact portion. The posts 304 extend perpendicularly away from an end face of the housing 302 and are fixedly mounted to the housing 302. In other embodiments (not illustrated), the posts 304 are telescopic and operable to retract at least partially within the housing 302. Each post 304 may include a magnetic portion to cause drawing the post 304 towards the core tube 14. As illustrated in FIG. 13B, the configuration of the posts 304 allows mounting the device 300 along a sidewall of the core tube 14.

The marking guide 22 of this embodiment 300 is integrally formed with the housing 302 to extend between opposed ends of the housing 302, and partway across the housing 302. The marking guide 22 is configured in substantially the same way as described above, including having marking surfaces defined at opposed sides of an elongate slot 42, and the slot 42 is dimensioned to receive a marking implement.

The guide 22 is associated with an aspect of the user interface 28 being a plurality of light emitters 306 mounted about an end face of the housing 302 in an arced array at either side of the slot 42. The emitters 306 are configured to be selectively operable, in some embodiments being sequentially operated, by the processor 30, to indicate the direction of relative rotation necessary to align the marking guide 22 with the marking position, and to confirm the marking guide 22 is aligned with the marking position.

The exposed end of one of the posts 304 has a port 308 defining a signal path to the communications module 26 arranged within the housing 302 or within the post 304. As illustrated in FIG. 13C, the end of the post 304 is shaped to fit to the downhole assembly, such as by mating with, or being received in, one of the water ports 56 of the grease cap 52, to allow communication with the downhole unit 16.

Figure 14A:
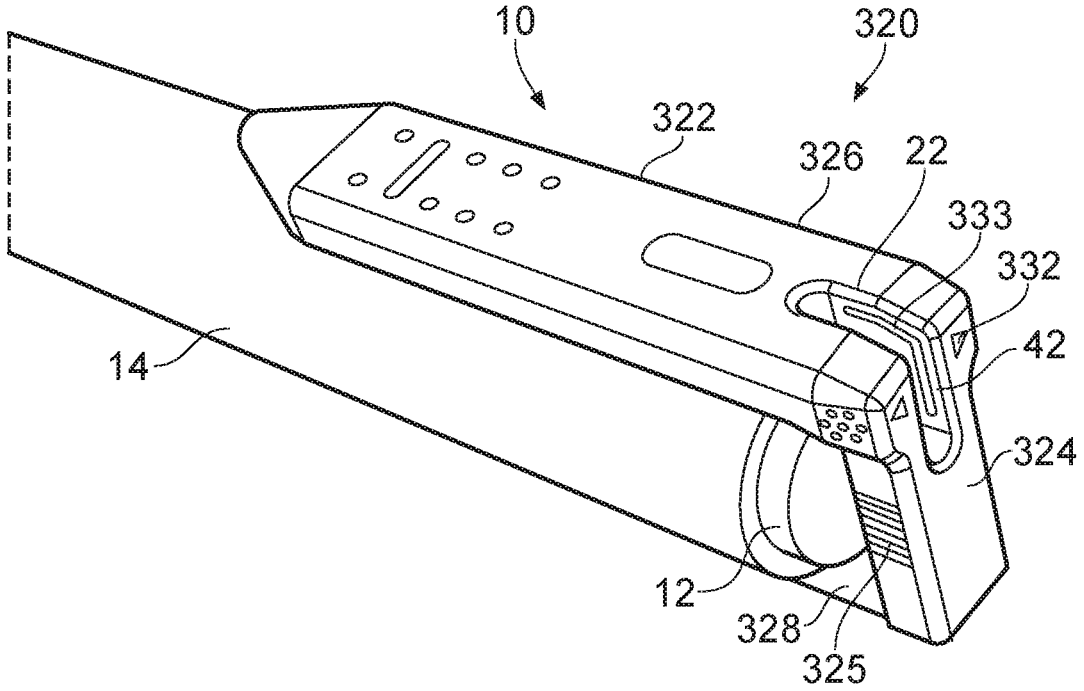
FIGS. 14A and 14B are perspective views of an eighth embodiment of a device for guiding a user to mark a core sample in use, arranged relative to a core tube and grease cap, respectively.
Figure 14B:
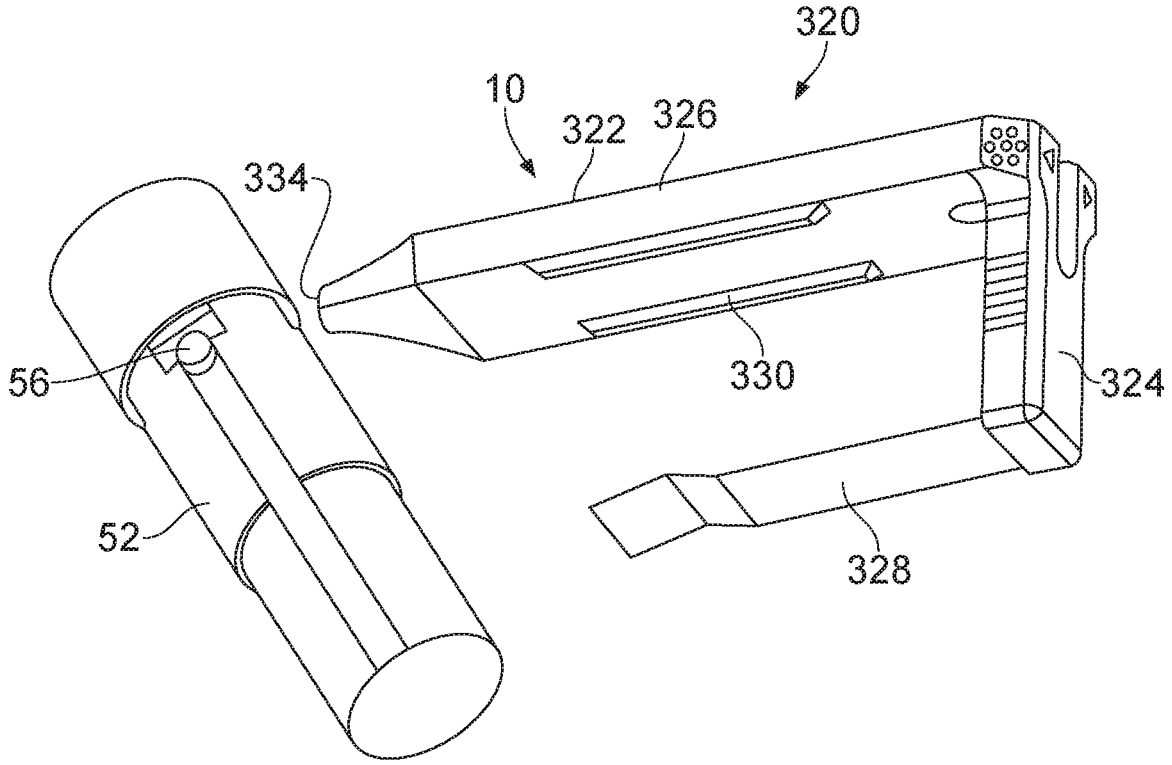

The embodiment 320 shown in FIGS. 14A and 14B has a housing 322 mountable on a sidewall of the core tube 14, or side of the core sample 12. The housing 322 includes a handle portion 324 extending away from a main body 326. In the illustrated embodiment 320, the handle portion 324 is arranged substantially perpendicularly to the main body 326 to allow closely fitting to a side and end of the core sample 12. The handle portion 324 is shaped to enhance manual grasping by a user, such as defining ribs 325. In some embodiments, the handle portion 324 is shaped to form a pistol grip to enhance the ergonomics of the device 320.

Best shown in FIG. 14B, in the illustrated embodiment 320, a resiliently deformable tongue portion 328 extends from the handle portion 324 to be spaced from, and substantially parallel to, the main body 326. As illustrated in FIG. 14A, the spacing between the tongue portion 328 and the main body 326 is dimensioned to allow the tongue portion 328 and main body 326 to frictionally engage opposed sides of the core tube 14 when the housing 322 is mounted to the tube 14. In this embodiment, the spacing between the tongue portion 328 and the main body 326 is fixed and the tongue portion 328 is biased towards the main body 326 such that mounting the housing 322 on the core tube 14 cause the tongue portion 328 to flex away from the main body 326. In other embodiments (not illustrated), the tongue portion 328 is carried by an adjustment mechanism operable to move the tongue portion 328 towards or away from the main body 326 to allow adjusting the spacing to clamp the housing 322 to different sized core tubes 14.

As shown in FIG. 14B, the housing 322 typically carries one or more magnetic members, in this embodiment in the form of magnetic rails 330 each defining a contact portion, arranged to allow drawing the housing 322 towards the core tube 14. In some embodiments (not illustrated), the tongue portion 328 is absent, or removable, and the housing 322 is held on to the core tube 14 only by the magnetic members. It will be appreciated that, in other embodiments, the magnetic members may arranged inside the housing 322, and/or define or form part of other structures, such as rollers or bearings rotatably mounted to the housing 322 such as to allow or enhance rotating the housing about the core tube 14. In yet other embodiments, the magnetic members may be absent and the housing 322 only be retained on the core tube 14 by the gripping force of the tongue portion 328.

The marking guide 22 of this embodiment 320 is integrally formed with the housing 322 at a junction between the main body 326 and the handle portion 324 to allow access to a side and end of the core sample 12. The marking guide 22 is configured in substantially the same way as described above, including having marking surfaces defined at opposed sides of an elongate slot 42, and the slot 42 being dimensioned to receive a marking implement.

The guide 22 is associated with an aspect of the user interface 28 being a pair of light emitters 332 arranged either side of the slot 42. The emitters 332 are configured to be selectively operable, by the processor 30, to indicate the direction of relative rotation necessary to align the marking guide 22 with the marking position. A further one or more light emitters 333 may be arranged within the slot 42 and be operable, by the processor 30, to indicate proximity of the marking guide 22 to the marking position, such as by emitting different coloured light depending on angular distance of the marking guide 22 from the marking position. For example, the one or more further light emitters 333 may be configured such that the slot 42 glows: red when the slot 42 is far away from (such as greater than a first defined tolerance) the marking position; white when the slot 42 is close to (within the first defined tolerance) the marking position; and green when the slot 42 is aligned with (within a second defined tolerance) the marking position.

The end of the main body 326 has a port 334 defining a signal path to the communications module 26 arranged within the housing 322. As illustrated in FIG. 14B, the port 334 is readily directable at, or mateable with, the downhole assembly, such as by aligning with one of the water ports 56 of the grease cap 52, to allow communication with the downhole unit 16.

Figure 15A:
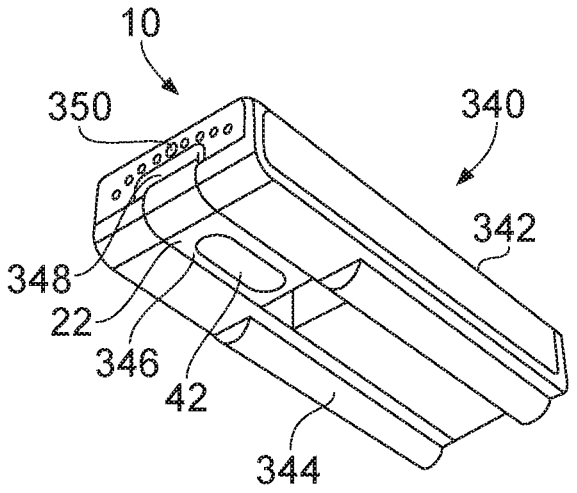
FIGS. 15A and 15B are perspective views of ninth embodiment of a device for guiding a user to mark a core sample.
Figure 15B:
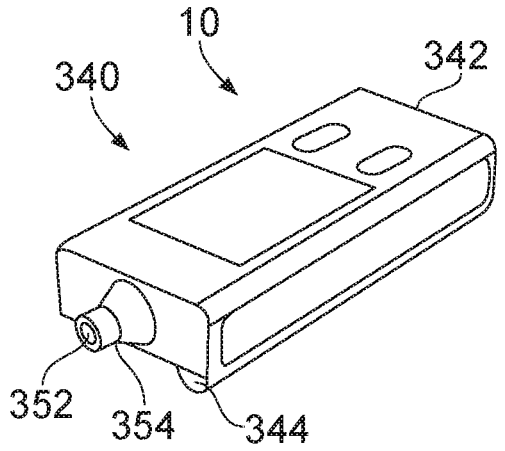
Figure 15C:
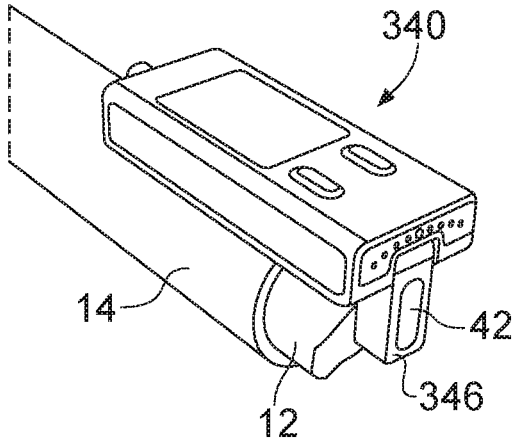
FIGS. 15C and 15D are perspective views of the embodiment shown in FIGS. 15A and 15B in use, arranged relative to a core tube and grease cap, respectively.

The embodiment 340 shown in FIGS. 15A to 15D has a housing 342 mountable on a sidewall of the core tube 14, or side of the core sample 12, as shown in FIG. 15C. Best shown in FIG. 15A, the housing 342 carries one or more magnetic members, in this embodiment in the form of a pair of elongate rails 344, each defining a contact portion. It will be appreciated that, in other embodiments, the magnetic members may be internal to the housing 342 and/or comprise other structures, such as rollers or bearings rotatably mounted to the housing 342 to enhance or control rotation of the housing 342 about the axis 13 of the core sample 12 when mounted to the core tube 14. In yet other embodiments, the magnetic members may be absent.

The marking guide 22 of this embodiment 340 includes a guide body 346 pivotably mounted to the housing 342 to pivot between a use position (FIG. 15C) and a storage position (FIG. 15A). The marking guide 22 is configured in substantially the same way as described above, including having marking surfaces defined at opposed sides of an elongate slot 42, and the slot 42 being dimensioned to receive a marking implement. In the use position, the guide body 346 is arranged to extend away from the housing 342, in this embodiment being perpendicular to the housing 342, to allow positioning the slot 42 across an end of the core sample 12. In the storage position, the guide body 346 is at least partially received within a recess 348 defined by the housing 342. The guide body 346 may be associated with a retention or locking mechanism operable to inhibit the guide body 346 pivoting relative to the housing 342, the retention of locking mechanism typically being operable to inhibit rotation of the body 346 when at the use position and the storage position.

The guide body 346 is associated with an aspect of the user interface 28 being an arc-shaped array of light emitters 350 mounted about an end face of the housing 342 to be arranged about the slot 42 when the guide body 346 is in the use position. In other embodiments (not illustrated), the emitters 350 are mounted about a top face of the housing 342 to be adjacent the guide body 346. The emitters 350 are configured to be selectively operable, in some embodiments being sequentially operated, by the processor 30, to indicate the direction of relative rotation necessary to align the slot 42 with the marking position, and may be operable to confirm the marking guide 42 is within a tolerance distance from the marking position.

Figure 15D:
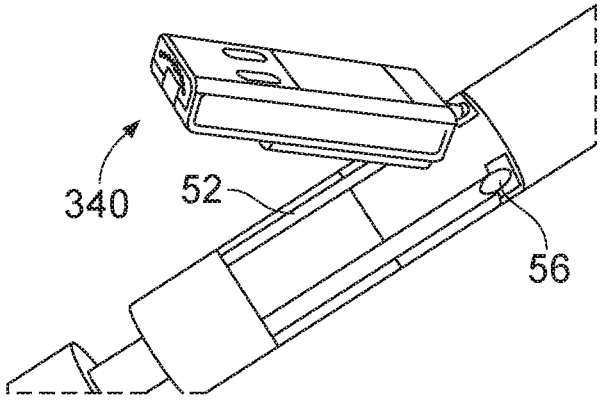

The end of the housing 342 carries a port 352 at an end of a projection, in this embodiment being a stud 354. The port 352 defines a signal path to the communications module 26 arranged within the housing 342. As illustrated in FIG. 15D, the port 352 is readily directable at, or mateable with, the downhole assembly, such as by aligning with one of the water ports 56 of the grease cap 52, to allow communication with the downhole unit 16.

Figure 18A:
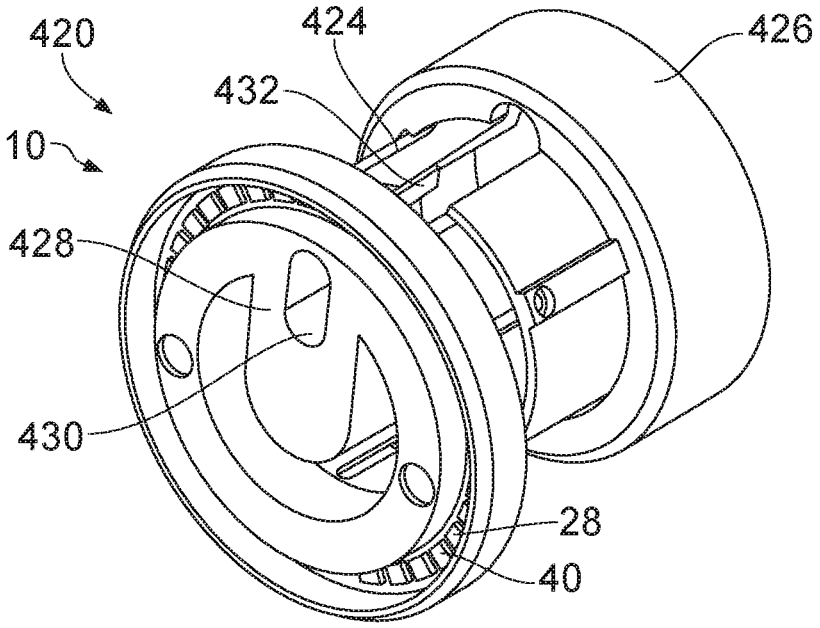
FIGS. 18A to 18D are perspective and side views of a twelfth embodiment of a device for guiding a user to mark a core sample.
Figure 18B:
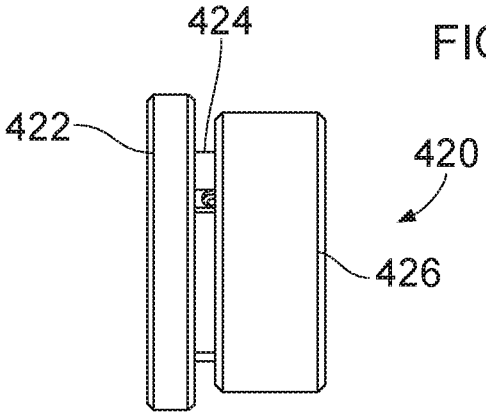
Figure 18C:
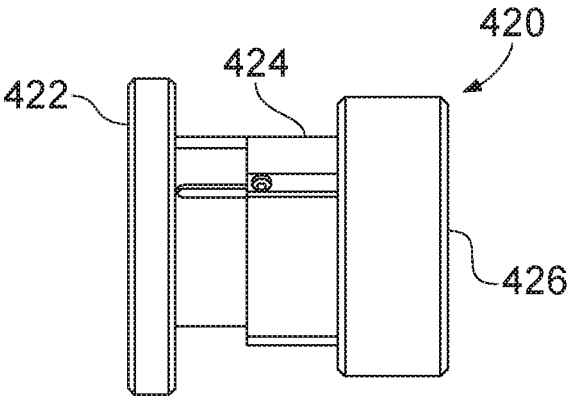
Figure 18D:
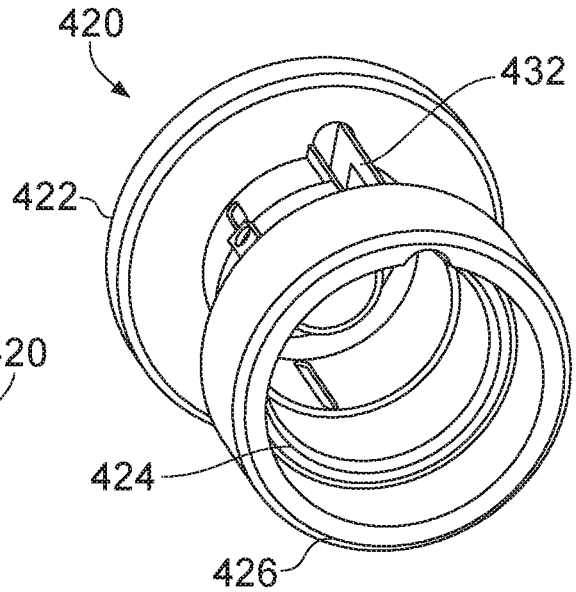

The embodiment 420 shown in FIGS. 18A to 18D has a housing 422 mountable relative to a sidewall of the core tube 14, or side of the core sample 12. The housing 422 carries a plurality of adaptor portions 424, 426 slidingly engaged with each other and the housing 422 to form a telescopic structure. Each adaptor portion 424, 426 defines an internal diameter dimensioned to receive a specific size of core tube 14 or core sample 12 to allow readily configuring the device 420 to be mountable to a range of core tubes 14 and/or samples 12. Best shown in FIG. 18D, in this embodiment 420, the inner adaptor 424 is dimensioned to slidingly engage a "N" size core tube 14, and the outer adaptor 426 is dimensioned to slidingly engage a "N2" size core tube 14. Configuring the housing 422 and adaptors 424, 426 in this way allows sliding the adaptors 424, 426 and housing 422 together, to an compressed configuration, as shown in FIG. 18B, for storage and transport, and sliding the adaptors 424, 426 and housing 422 apart, to an expanded configuration, as shown in FIG. 18C, for use to guide marking the core sample 12.

The housing 422 includes a marking guide 428 having an end slot 430 arrangeable, in use, to allow marking the end of the core sample 12, and a side slot 432 arrangeable, in use, to allow marking the side of the core sample 12. Each slot 430, 432 is configured to receive a marking implement or mechanism to effect marking of the core 12. Each adaptor 424, 426 defines part of at least one of the slots 430, 432 to allow the marking implement or mechanism to access the core sample 12 when the housing 422 is mounted to the core tube 14 by the relevant adaptor 424, 426. The housing 422 carries the user interface 28, in this embodiment 420 including the annular array of light emitters 40, as previously described, operable to guide relative rotating of the housing 422 and core sample 12 to align the marking guide 424 with the marking position and allow marking the core sample 12.

It will be appreciated that configuring the device 420 to include the two adaptors 424, 426 is exemplary and that, in other embodiments, the device 420 may include more, or less, adaptors. Each adaptor 424, 426 may be formed from a plastic moulding, such as formed from nylon, to reduce friction with the core tube 14 and/or the other adaptor 424, 426 and housing 422, and/or minimise cost and complexity of replacement, such as because of damage caused to the adaptor 424, 426 during use.

Use of the device 10 to mark the core sample 12 may involve: operating the downhole tool 16, when associated with the core tube 14, to record data relating to the orientation of the core sample 12 in situ, prior to or immediately after being broken from bedrock; operating the device 10 to communicate with the downhole tool 16 to receive the core orientation data, where receiving the core orientation data causes the processor 30 to determine a marking position relative to the longitudinal axis 13 of the core sample 12, the marking position typically corresponding with a Bottom of Core, or Top of Core, location when the core sample 12 was in situ; positioning the device 10 relative to the core sample 12; operating the device 10 such that the user interface 28 conveys feedback to guide rotating at least a portion of the device 10 about the core sample 12, and/or rotating the core sample 12 relative to the device 10, to align the marking guide 22 with the marking position; and using the marking guide 22 to mark the core sample 12 at the marking position, such as by sliding an implement along a marking surface of the marking guide 22.

Optionally, the device 10 is also operable to cause the processor 30 to store its current orientation as a marked orientation in the memory 32, and then communicate with the downhole unit 16 to verify if the marked orientation corresponds with the orientation data stored in the downhole unit 16.

Use of the device 10 to mark the core sample 12 may alternatively involve: operating the downhole tool 16, when associated with the core tube 14, to record data relating to the orientation of the core sample 12 in situ, prior to or immediately after being broken from bedrock; positioning the device 10 relative to the core sample 12 or the core tube 14 and using the marking guide 22 to apply a first mark to the core sample 12 at a first position; operating the device 10 to record the first position; operating the device 10 to communicate with the downhole tool 16 to receive the core orientation data, such that receiving the core orientation data causes the processor 30 to determine a marking position, the marking position typically corresponding with a Bottom of Core, or Top of Core, location when the core sample 12 was in situ; positioning the device 10 relative to the core sample 12 and operating the device 10 such that the user interface 28 conveys feedback to guide rotation of the device 10 and/or the core sample 12 so that the marking guide 22 is aligned with the marking position; and, using the marking guide 22, applying a second mark to the core sample 12 at the marking position.

In some embodiments, recording the first position may involve the processor 30 determining a gravity vector, such as by operating an accelerometer associated with the device 10, and recording the first position relative to the gravity vector, such as by defining a rotational angle based on the gravity vector. Alternatively or additionally, this may involve the processor 30 determining the axis 13 of the core sample 12, and recording the first position relative to the axis 13.

In some embodiments, the processor 30 is configured so that, responsive to receiving the core orientation data, the processor 30 determines a delta (difference) between a position defined by the core orientation data, such as the Bottom of Core position, and the first position, and calculates the marking position based on the delta. This then allows the processor 30 to operate the user interface 28 to guide appropriate relative rotation of the device 10 and core sample 12 to align the marking guide 22 with the marking position.

In the use scenario described above, the location of the first position, and therefore the location of the first mark, may be arbitrary. The location of the first position may be selected by a user because of ease of access to place the first mark on the core sample 12. After the first mark location is recorded by the device 10, and the device 10 is operated to communicate with the downhole tool 16 to obtain the core orientation data, the core sample 12 may be removed from the core tube 14 and the device 10 then operated to guide applying the second mark at the marking position on the core sample 12. This can advantageously allow the second mark to be applied some time after removal of the core sample 12 from the core tube 14, such as when the core sample 12 is transported to a more convenient or spacious location, for example, in a core shed at a mine site.

In embodiments of the device 10 including the imaging module, such as embodiment 100 described above, use of the device 10 may allow identifying orientation of the core sample 12 in situ, prior to or immediately after being broken from bedrock. The use may include: operating the downhole tool 16 associated with the core tube 14 arranged to receive the core sample 12 so that the tool 16 records orientation data relating to the orientation of the core sample 12 in situ, prior to or immediately after being broken from the bedrock; obtaining, via the communications module 26, the orientation data from the downhole tool 16; determining, by the processor 30, a marking position based on the orientation data; positioning the imaging system relative to the core sample 12 and operating the imaging system to generate a digital representation of a portion of the core sample 12; and manipulating, by the processor 30, the digital representation to identify the marking position.

The disclosed devices and methods enhance ease and/or reliability of accurately adding a mark to a core sample to indicate core orientation in situ. The disclosed concepts do not require rotation of a heavy core sample or core tube, instead only requiring rotation of the housing and/or marking guide of the device. This is significantly less physically demanding than conventional approaches, and may allow reducing injury and associated absences of workers.

The disclosed devices are configured to communicate with a downhole tool to obtain core orientation data, determine a marking position, such as the BoC/or ToC position, based on the obtained data, and guide a user to add a mark on the core sample at the marking position, or be operated to directly mark the core sample at the marking position. This configuration avoids requiring a separate handheld controller and marking jig, either of which may be misplaced and/or broken during use.

The disclosed devices are configurable to communicate with the downhole tool while connected to downhole and uphole components of an assembly. This avoids de-tooling the downhole tool from another component which can cause rotation of the core sample relative to the core tube/downhole tool, which can invalidate the core orientation data, rendering the core sample worthless.

It will be appreciated by persons skilled in the art that numerous variations and/or modifications may be made to the above described embodiments, without departing from the broad general scope of the present disclosure. The present embodiments are, therefore, to be considered in all respects as illustrative and not restrictive.

The invention claimed is:

1. A device for guiding a user to mark a core sample carried by a core tube, the core tube associated with a downhole tool configured to record data relating to the orientation of the core sample in situ, prior to or immediately after being broken from bedrock, the core sample defining a longitudinal axis between opposed ends, the device including:

a housing having a marking guide configured to be arranged, in use, adjacent at least one of an end and side of the core sample, the housing being mountable relative to the core sample or the core tube to allow relative rotation of the marking guide and the core sample about the longitudinal axis of the core sample;

a communications module carried by the housing and operable to communicate with the downhole tool to receive data;

a user interface carried by the housing and operable to convey perceptible feedback to the user; and a processor and associated memory carried by the housing, the processor communicatively coupled to the communications module and the user interface, and configured to store the data in the memory, the processor further configured to determine a marking position based on the data, and operate the user interface to direct the user to cause relative rotation of the marking guide and the core sample so that the marking guide is aligned with the marking position, thereby allowing the user to use the marking guide to mark the core sample at the marking position.

2. The device of claim 1, wherein the user interface includes at least one light emitter, and the processor is configured to selectively illuminate the at least one light emitter to indicate a direction of the relative rotation.

3. The device of claim 2, including a plurality of the light emitters configured to be arranged, in use, at least partially about the longitudinal axis, and wherein the processor is configured to selectively illuminate one or more of the light emitters to indicate the direction of the relative rotation.

4. The device of claim 3, wherein the processor is configured to operate a first light emitter to emit a first light to indicate the marking position, and operate one or more second light emitters to emit a second light to indicate the location of the marking guide, and wherein the first light comprises a first colour, and the second light comprises a second colour.

5. The device of claim 4, wherein the processor is configured to operate the one or more second light emitters to indicate a direction of rotation of the marking guide towards the marking position; and wherein the processor is configured to operate one or more of the light emitters to pulse light when the marking guide is aligned with the marking position.

6. The device of claim 3, wherein the light emitters are arranged in an annular array configured, in use, to at least partially surround the longitudinal axis; and wherein the annular array is configured to be arranged, in use, adjacent an end of the core sample.

7. The device of claim 1, wherein the housing defines, or carries, one or more contact portions arranged to be placed against a side of the core sample or the core tube to allow mounting the housing relative to the core sample or core tube, wherein the one or more contact portions are defined by a receiving portion dimensioned to receive part of the core tube, and wherein the receiving portion includes a sleeve mountable to, or integrally formed with, the housing.

8. The device of claim 7, wherein the sleeve defines one or more guiding surfaces, the, or each, guiding surface arranged to allow marking the side of the core sample.

9. The device of claim 8, wherein the sleeve defines a pair of the guiding surfaces spaced equally from opposed sides of the centre line such that each guiding surface is arranged at 45 degrees or 90 degrees to the centre line.

10. The device of claim 7, further including an insert securable within the receiving portion, the insert defining an internal diameter dimensioned to fit to the core tube and is slidably engageable with the receiving portion to allow moving axially relative to the housing along the longitudinal axis.

11. The device of claim 7, including at least a pair of contact portions, and wherein each contact portion includes an elongate magnetic member arranged to allow releasably mounting the housing on a sidewall of the core tube.

12. The device of claim 7, including at least three contact portions arranged to define an annular array, and wherein each contact portion is radially displaceable relative to a centre of the array, and wherein each contact portion is defined by an elongate member extending from the housing.

13. The device of claim 1, further including one or more planar light emitters arranged to emit a plane of light, the, or each, planar light emitter aligned with the marking guide to allow illuminating the core sample to display a line along the core sample.

14. The device of claim 1, wherein the marking guide defines one or more surfaces configured to be arranged along at least one of the side and end of the core sample to allow guiding the user to mark the core sample, and wherein the marking guide defines an aperture dimensioned to receive an implement operable to apply a mark.

15. The device of claim 14, wherein the marking guide is associated with a detector arranged to detect presence of the implement adjacent the one or more surfaces, the detector communicatively coupled with the processor such that responsive to the detector detecting the implement, the processor is configured to record a marking event in the memory.

16. The device of claim 1, wherein the marking guide includes an annular array of light emitters configured to be arranged, in use, about an end of the core sample, and wherein the processor is configured:

(a) to illuminate a pair of opposed light emitters located either side of the marking position such that the marking position is coincident with a straight line between the opposed emitters, whereby illuminating the opposed emitters guides the user to mark a line along the sample between the opposed emitters; or (b) to illuminate at least one of the emitters to project a line at least partway across the end of the core sample such that the marking position is coincident with the line to guide the user to mark the line along the sample.

17. The device of claim 1, wherein the user interface is operable to convey one or more of visible, audible, and haptic feedback to the user to direct the user to cause the relative rotation.

18. The device of claim 1, wherein the user interface includes a display operable to display graphics to direct the user to cause the relative rotation.

19. The device of claim 1, wherein the marking guide is movably engaged with the housing to allow moving between a storage position and a use position and wherein the marking guide is releasably engaged with the housing to allow detaching from the housing.

20. The device of claim 1, including a marking alignment button operable to cause the processor to store a current orientation of the device in the memory, wherein responsive to storing the current orientation, the processor is operable to communicate with the downhole tool, via the communications module, to confirm if the stored current orientation corresponds with the core orientation data stored in the downhole tool.

21. The device of claim 1, wherein the downhole tool is connected to the core tube and an uphole component, and the communications module is configured to allow communication with the downhole tool when connected to the core tube and the uphole component, and wherein the uphole component defines at least one communication path, and the communications module is carried by the housing to allow communication with the downhole tool via the at least one communication path.

22. The device of claim 21, further including a second communications module configured to communicate with the downhole tool and communicatively coupled to the processor, the second communications module arranged by the housing to allow communicating with the downhole tool when connected to the core tube and disconnected from the uphole component, and wherein the processor is configured to execute first instructions responsive to receiving the data from the communications module, and configured to execute second instructions responsive to receiving data from the second communications module.

23. The device of claim 1, further including an imaging module communicatively coupled with the processor and operable to generate an image of the core sample, wherein the imaging module is fixedly mounted to the housing to allow positioning the imaging module adjacent the core sample.

* * * * *